US008740350B2

(12) United States Patent
Sakurai et al.

(10) Patent No.: US 8,740,350 B2
(45) Date of Patent: Jun. 3, 2014

(54) INKJET RECORDING HEAD SUBSTRATE AND DRIVE CONTROL METHOD, INKJET RECORDING HEAD, INKJET RECORDING HEAD CARTRIDGE AND INKJET RECORDING APPARATUS

(75) Inventors: Masataka Sakurai, Kawasaki (JP); Tatsuo Furukawa, Zama (JP); Hidenori Watanabe, Zama (JP); Nobuyuki Hirayama, Fujisawa (JP); Ryo Kasai, Setagaya-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 471 days.

(21) Appl. No.: 12/482,201

(22) Filed: Jun. 10, 2009

(65) Prior Publication Data

US 2009/0262167 A1 Oct. 22, 2009

Related U.S. Application Data

(63) Continuation of application No. 11/289,697, filed on Nov. 30, 2005, now Pat. No. 7,559,626.

(30) Foreign Application Priority Data

Dec. 9, 2004 (JP) ..... 2004-357182
Dec. 9, 2004 (JP) ..... 2004-357184

(51) Int. Cl.
*B41J 2/15* (2006.01)

(52) U.S. Cl.
USPC ..... 347/40; 347/20; 347/54

(58) Field of Classification Search
None
See application file for complete search history.

(56) References Cited

U.S. PATENT DOCUMENTS

| | | | | |
|---|---|---|---|---|
| 5,689,296 | A | 11/1997 | Heitmann et al. | |
| 5,933,161 | A | 8/1999 | Sato et al. | |
| 6,290,334 | B1 | 9/2001 | Ishinaga et al. | |
| 6,302,504 | B1 | 10/2001 | Imanaka et al. | |
| 6,471,324 | B1 | 10/2002 | Maru | |
| 7,133,153 | B2 | 11/2006 | Furukawa | |
| 7,161,396 | B1 * | 1/2007 | Zhou et al. | 327/143 |
| 2005/0104621 | A1 * | 5/2005 | Kawahara et al. | 326/39 |
| 2006/0125871 | A1 | 6/2006 | Furukawa | |
| 2006/0125872 | A1 | 6/2006 | Sakurai | |
| 2006/0209131 | A1 | 9/2006 | Furukawa | |

FOREIGN PATENT DOCUMENTS

| | | | |
|---|---|---|---|
| JP | 09-300621 | A | 11/1997 |
| JP | 10138484 | A | 5/1998 |
| JP | 2002-172782 | A | 6/2002 |
| TW | 445955 | | 11/2001 |

* cited by examiner

*Primary Examiner* — Justin Seo
(74) *Attorney, Agent, or Firm* — Fitzpatrick, Cella, Harper & Scinto

(57) ABSTRACT

An inkjet recording head substrate having an electrothermal transducer for generating thermal energy used to discharge ink and a drive element for driving the electrothermal transducer mounted thereon includes a first circuit portion for outputting selection signals for selecting the electrothermal transducer to be driven at a amplitude level of a second voltage higher than a first voltage based on an input signal of the amplitude level of the first voltage, a second circuit portion for inputting the selection signals from the first circuit portion and controlling the drive element corresponding to the electrothermal transducer to be driven based on the selection signals subject to the second voltage, and a plurality of signal lines for transmitting the selection signals between the first and second circuit portions.

18 Claims, 21 Drawing Sheets

INKJET RECORDING HEAD SUBSTRATE AND DRIVE CONTROL METHOD, INKJET RECORDING HEAD, INKJET RECORDING HEAD CARTRIDGE AND INKJET RECORDING APPARATUS

CROSS REFERENCE TO RELATED APPLICATION

This application is a continuation application of U.S. patent application Ser. No. 11/289,697, filed Nov. 30, 2005, the entire disclosure of which is incorporated herein by reference.

FIELD OF THE INVENTION

The present invention relates to an inkjet recording head substrate, an inkjet recording head and a recording apparatus using the recording head, and in particular, to the inkjet recording head having an electrothermal transducer for generating thermal energy necessary to discharge ink and a drive circuit for driving it formed on the same substrate and the recording apparatus using the recording head.

BACKGROUND OF THE INVENTION

In general, an electrothermal transducer (heater) and its drive circuit of a recording head mounted on a recording apparatus compliant with an inkjet method are formed on the same substrate by using a semiconductor process technology as indicated in U.S. Pat. No. 6,290,334 for instance. There is a proposal of a configuration of the recording head having a digital circuit for detecting a state of a semiconductor substrate such as a substrate temperature for instance formed on the same substrate in addition to the drive circuit and also having an ink supply port around the center of the substrate and the heaters at opposed positions across the port.

FIG. 1 is a diagram schematically showing circuit blocks and the ink supply ports of this kind of inkjet recording head substrate (head substrate). FIG. 1 shows the semiconductor substrate of a head substrate 114 on which six ink supply ports 111 are formed. For convenience sake, FIG. 1 only shows the circuit blocks corresponding to the ink supply ports 111 on the left side and omits showing circuit blocks (115) corresponding to the other five ink supply ports 111. As shown in FIG. 1, heaters 110 are placed like an array at opposed positions across the ink supply ports 111. The circuit blocks (drive circuits 113) for selectively driving the heaters 110 are placed correspondingly to the heaters 110. Pads 102 for supplying power and signals to the heaters 110 and drive circuits 113 are placed at ends of the semiconductor substrate 114.

FIG. 2 is a diagram showing one of the supply port circuit blocks 115 shown in FIG. 1 in further detail together with a flow of an electrical signal. As shown in FIG. 2, the circuit blocks (drive circuits 113 of FIG. 1) are symmetrically placed centering on the ink supply port 111. The circuit blocks include a drive circuit array 109, a drive selection circuit array 108, a device driving signal circuit 104, a block selection circuit 105 and bus lines 106, 107 described later. The heater arrays 110 are provided across the ink supply port 111 and comprise multiple heaters. The drive circuit array 109 has a switching device for passing a current to each heater of the heater array 110. The drive selection circuit array 108 controls the drive circuit. The device driving signal circuit (also referred to as a time division selection circuit) 104 and block selection circuit 105 generate the signals transmitted to the drive selection circuit array 108. An input circuit 103 processes the signals inputted from the pads 102.

Hereunder, a description will be given as to functions of each of the circuit blocks and flows of the signals of one circuit block group which is symmetrical centering on the ink supply port 111.

A head substrate 101 is a silicon substrate on which the circuit blocks and the heaters for heating ink are formed by using an LSI process. The power supply voltage and signals inputted from the pads 102 for inputting and outputting image data are transmitted to the device driving signal circuit 104 and block selection circuit 105 via the input circuit 103. The signals appropriately processed by the device driving signal circuit 104 and block selection circuit 105 are led to a heater row direction by the bus lines 106 and 107 consisting of multiple lines.

The signals from the bus lines 106 and 107 are connected to drive selection circuits which are components of the drive selection circuit array 108 respectively. On and off of drive selection circuits are decided by the signals from the bus lines 106 and 107. In the case of performing a discharge operation of the ink, the signal for turning on a desired drive selection circuit is applied to the bus lines 106 and 107, and the signal is outputted from the drive selection circuit to turn on a corresponding drive circuit in the drive circuit array 109. The turned-on drive circuit passes a current to the corresponding heater in the heater array 110. The heater is heated by this current, and bubbling and discharge operations of the ink are performed.

FIG. 3 schematically shows more detailed circuit configuration and flows of signals of the drive circuits 113 of FIG. 1 (drive circuit array 109, drive selection circuit array 108, device driving signal circuit 104, block selection circuit 105 and bus lines 106, 107 of FIG. 2). The shown example indicates a state in which the drive circuit array 109 and drive selection circuit array 108 are configured by eight heater driving blocks 206. The signals including the image data and time division data applied to the pads 102 are inputted to the block selection circuit (mainly configured by a shift register) 105 and device driving signal circuit (mainly configured by a decoder) 104 configuring an internal circuit via the input circuit 103. In the example shown in FIG. 3, the inputted time division data is converted to a time division selection signal (also referred to as a device driving signal) by the device driving signal circuit 104. The time division selection signal is supplied to each of the heater driving blocks 1 to 8 (206). The block selection circuit 105 generates a block selection signal for selecting the heater driving blocks 1 to 8 based on an image data signal synchronized with a synchronizing signal (clock) used to input the image data. The heater driving block selected by the block selection signal drives the heater according to the time division selection signal. To be more specific, the heater to be driven is decided by an AND of the block selection signal and the time division selection signal.

FIG. 4 shows a detailed configuration of the heater driving block 206. The heater driving block 206 includes heater driving MOS transistors 209, level conversion circuits 205 and heater selection circuits 204 placed correspondingly to heaters 210 placed like an array. Here, the heater driving MOS transistor 209 performs a function of a switch for turning on and off energization of the heater 210. The drive selection circuit array 108 of FIG. 2 corresponds to the heater selection circuits 204 and level conversion circuits 205. The drive circuit array 109 corresponds to the heater driving MOS transistor 209. A block selection signal 202 from the block selection circuit 105 and a time division selection signal 203 from the device driving signal circuit 104 are inputted to an AND gate of the heater selection circuit 204. Therefore, in the case where both the signals 202 and 203 become active, an output of that AND gate becomes active. An output signal of the AND gate has its voltage amplitude level-converted by the level conversion circuits 205 to the power supply voltage (second power supply voltage) higher than a driving voltage (first power supply voltage) from the input circuit 103 to the heater selection circuits 204. The level-converted signal is applied to a gate of the heater driving MOS transistor 209. The heater 210 connected to the heater driving MOS transistor 209 having the signal applied to its gate has a current passed thereto and driven. The second power supply voltage is level-converted by the level conversion circuits 205 for the purposes of increasing the voltage applied to the gate of the heater driving MOS transistor 209 and thereby reducing its on-resistance and passing the current to the heater with high efficiency.

FIG. 5 is a circuit diagram showing the drive selection circuit and drive circuit corresponding to one arbitrary heater 210 in the heater array 110 extracted from the above-mentioned drive selection circuit array 108 and drive circuit array 109. FIG. 5 describes a detailed circuit configuration of the heater selection circuits 204 and level conversion circuits 205 shown in FIG. 4.

The signals are taken into the drive selection circuit from the bus lines 106, 107 leading the output signals from the device driving signal circuit 104 and block selection circuit 105 shown in FIG. 2. Reference characters 208*a* to 208*l* denote circuit elements configuring the drive selection circuits (heater selection circuit 204 and level conversion circuit 205). An input terminal of an NAND gate 208*a* (heater selection circuit 204) is connected to the bus lines 106 and 107 and a corresponding signal is inputted from each bus line. An inverter 208*b* outputs the signal having inverted the output signal from the NAND gate 208*a*, and an inverter 208*c* further inverts the inversion signal. The MOS transistors 208*d* to 208*i* configure a level converter for converting the voltage amplitude of the signals. The MOS transistors 208*j*, 208*k* configure the inverter for buffering the output signals of the level converter. There is also a resistance 208*l* provided to increase an output impedance when the output of the inverter formed by the MOS transistors 208*j*, 208*k* shifts from a low level (hereafter, indicated as Lo) to a high level (hereafter, indicated as Hi).

A MOS transistor 209 forms the drive circuit for exerting on and off control of a heater current. Heating by the heater 210 for ink foaming is controlled by on and off of the heater current by the MOS transistor 209.

Operations of the circuits shown in FIG. 5 will be described. The output signals from the device driving signal circuit 104 and block selection circuit 105 of FIGS. 2 and 3 are inputted to the NAND gate 208*a* by the bus lines 106 and 107. Here, the output of the NAND gate 208*a* becomes Lo only when both the inputs to the NAND gate 208*a* become Hi. Hereunder, the operation in the case where a Lo signal is outputted from the NAND gate 208*a* will be described. The Lo signal outputted from the NAND gate 208*a* is inverted by the inverter 208*b* to become Hi. Furthermore, the Hi signal as the output of the inverter 208*b* is inputted to the inverter 208*c* and is inverted again to be outputted as the Lo signal. The voltage amplitudes of the bus lines 106 and 107, NAND gate 208*a*, inverters 208*b* and 208*c* are VDD (first power supply voltage) of which potential has the same amplitude as the signals inputted from outside.

The output signals from the inverters 208*b* and 208*c* are in putted to the level converter including the MOS transistors 208*d* to 208*i* respectively. Here, the potential of Lo (0 V) which is the same as the output signal of the NAND gate 208*a* is applied to the gates of the MOS transistors 208*d* and 208*e*, and the potential of Hi (VDD) which is the inversion signal of the output of the NAND gate is applied to the gates of 208*g* and 208*h*.

The MOS transistor 208*g* having VDD applied to its gate is an NMOS transistor, and so it becomes on-state. For that reason, a drain terminal of the NMOS transistor 208*g* is connected to a GND potential at low impedance. The drain terminal of the NMOS transistor 208*g* is connected to the gate of a PMOS transistor 208*f*. For that reason, the gate of the PMOS transistor 208*f* is connected to the GND potential at low impedance, and the PMOS transistor 208*f* becomes on-state. The PMOS transistor 208*e* series-connected to the PMOS transistor 208*f* is on-state because 0 V is applied to the gate. The NMOS transistor 208*d* further series-connected is off-state because 0 V is applied to the gate. As the PMOS transistors 208*f*, 208*e* are on and the NMOS transistors 208*d* is off, the potential at the drain of the PMOS transistors 208*e* is VDDM. Therefore, the potential of a node having the drains of the PMOS transistor 208*e* and NMOS transistor 208*d* and the gate of the PMOS transistor 208*i* connected thereto becomes VDDM (second power supply voltage) which is a power supply potential of the level conversion circuits. For that reason, the PMOS transistor 208*i* becomes off-state. To be more specific, the PMOS transistor 208*i* becomes off and the NMOS transistor 208*g* becomes on. For that reason, the drain terminals of the PMOS transistor 208*g* and NMOS transistor 208*i* are connected, and the potential of the node connected to the gate of the PMOS transistor 208*f* is fixed at 0 V. The potential of the node becomes the output signal of the level converter, and is inputted to the gates of the inverter consisting of the NMOS transistor 208*j* and PMOS transistor 208*k*.

Thus, if 0 V is applied to the gates of the transistors of the inverter consisting of the NMOS transistor 208*j* and PMOS transistors 208*k*, the PMOS transistors 208*k* becomes on and the NMOS transistor 208*j* becomes off. Consequently, the inverter outputs the VDDM potential so that VDDM is applied to the gate of the NMOS transistor 209 which is the drive circuit for exerting on and off control of the heater. The NMOS transistor 209 having VDDM applied to its gate becomes on-state and passes the heater current from a heater power supply potential VH via the heater 210. The heater having the current passed through generates the heat necessary for the ink foaming and discharge.

Thus, the heater current passes when both the signals connected from the bus lines 106 and 107 to the NAND gate 208*a* become Hi.

Here, the resistance 208*l* is placed to curb a precipitous rising edge of the heater current. To be more specific, in the case where a gate potential of the NMOS transistor 209 for exerting on and off control of the heater current transits instantaneously from 0 V to the VDDM potential for the sake of turning on the heater current, the heater current also passes instantaneously. There are the cases where this change of the current becomes noise of the power supply and triggers a malfunction. The resistance 208*l* is inserted between the PMOS transistor 208*k* and the NMOS transistor 209 in order to prevent the malfunction. As the precipitous rising edge of the gate potential of the NMOS transistor 209 is curbed by a lagged effect of the on-resistance of the PMOS transistor 208*k*, series resistance of the resistance 208*l* and gate capacity of the NMOS transistor 209, an instantaneous flow of the heater current is curbed to prevent the malfunction.

FIG. 6 shows a portion equivalent to the level conversion circuit 205 extracted from the circuit shown in FIG. 5 (the resistance 208*l* is omitted). As shown in FIG. 6, the level conversion circuits 205 is divided into a circuit portion 205*a* for operating at the first power supply voltage (VDD) and a circuit portion 205*b* for operating at the second power supply voltage (VDDM). A heater selection signal 221 which is the output from the heater selection circuit 204 is inputted to the inverter 208*b* (configured by a PMOS transistor 230 and a NMOS transistor 231) for operating at the first power supply voltage. The inverter 208*b* generates a signal of an inversion logic of the heater selection signal 221, and applies it to the gates of the NMOS transistor 208*g* and PMOS transistor 208*h* operating at the second power supply voltage. The inversion signal of the inverter 208*b* is inputted to the inverter 208*c* to be inverted again. The output signals of the inverter 208*c* are applied to the gates of the NMOS transistor 208*d* and PMOS transistor 208*e* operating at the second power supply voltage. The circuit portion 205*b* outputs the signal converted to an amplitude of the second power supply voltage (VDDM) according to these signals.

As for the inkjet recording heads in general, the number of nozzles is increased and density thereof is furthered for the purposes of speeding up recording and/or improving a grade of recording. In the case of a thermal inkjet printer for discharging the ink by generating heat with the heater as mentioned above, however, it is necessary to use a high power supply voltage in order to have the energy required for the ink foaming and the discharge in conjunction therewith generated by the heater. Therefore, as to a drive control circuit of the heater, it is necessary for the component devices such as the transistors to secure a withstand voltage against the high power supply voltage. In general, size of each component device increases for the sake of securing the withstand voltage of the device 80 that a high-density (small-layout-pitch) circuit layout on the substrate becomes difficult.

For instance, the conventional circuit form as shown in FIG. 5 takes an AND of the signal transmitted from the device driving signal circuit 104 via the bus line 106 and the block selection signal transmitted from the block selection circuit 105 via the bus line 107. The voltage amplitude is increased as to the signals after taking the AND.

Such a configuration requires the circuit block for operating at the first power supply voltage (VDD) which is the voltage amplitude of the input signal and the circuit block for operating at a higher second power supply voltage (VDDM) to be applied to the gate of the MOS transistor for controlling the heater current. To be more specific, the head substrate must have the configuration for each of the heaters wherein it is controlled and driven at two kinds of power supply voltages, that is, the first and second power supply voltages, and a signal amplitude of the first power supply voltage is converted to that of the second power supply voltage by the level conversion circuit. For this reason, the level conversion circuit described in FIG. 6 is provided to each heater drive MOS transistor. However, such a level conversion circuit is configured by a large number of transistors, and so the required area of chips becomes large in the case of the configuration having the level conversion circuit for each individual heater.

As each of the heaters requires the level conversion circuit, it is necessary to place a large number of devices of a high withstand voltage. For this reason, a high-density (small-layout-pitch) device layout on the substrate becomes difficult. To be more specific, the layout pitch cannot be sufficiently reduced because of existence of the large number of devices of a high withstand voltage, resulting in an increase in a chip size.

As each of the heaters requires the level conversion circuit, it is necessary to place a large number of devices of a high withstand voltage. For this reason, a high-density (small-layout-pitch) device layout on the substrate becomes difficult. To be more specific, the layout pitch cannot be sufficiently reduced because of existence of the large number of devices of a high withstand voltage, resulting in an increase in a chip size.

The devices of a high withstand voltage of FIG. 5 are the level converter and inverter (circuit portion 205*b*) connected to VDDM which is a midpoint potential and the transistor (209) for driving the heater connected to VH.

Therefore, when considering a layout configuration of a recording head substrate of the above-mentioned configuration, the level conversion circuit added to each segment leads to an increase in length of each segment and an increase in the chip size and becomes a factor of increased costs. To be more specific, the above-mentioned layout expands the chips in the direction orthogonal to the heater array so that the chips increase remarkably. An increase in the number of circuit elements leads to reduction in yield and further complexity of the circuit configuration, which become the factors of further increased costs.

SUMMARY OF THE INVENTION

The present invention has been made in view of the problems, and an object thereof is to reduce the number of devices of a high withstand voltage placed in each segment and achieve higher density of a selection circuit.

Or an object of the present invention is to curb an increase in a substrate size by reducing a scale of a level conversion circuit and improve yield and simplify a circuit configuration by reducing the number of devices formed on a substrate.

Or an object of the present invention is to eliminate a malfunction and realize a stable operation in such reduction of the substrate size.

An inkjet recording head substrate for achieving the objects according to an embodiment of the present invention has the following configuration. To be more specific:

an inkjet recording head substrate having an electrothermal transducer for generating thermal energy used to discharge ink and a drive element for driving the electrothermal transducer mounted thereon, comprising:

a first circuit portion for outputting a selection signal for selecting the electrothermal transducer to be driven at an amplitude level of a second voltage higher than a first voltage based on an input signal of the amplitude level of the first voltage;

a second circuit portion including an NOR circuit for inputting the selection signal from the first circuit portion and controlling the drive element corresponding to the electrothermal transducer to be driven based on the selection signal subject to the second voltage; and a plurality of signal lines for transmitting the selection signal between the first and second circuit portions.

Another embodiment of the present invention provides a drive control method of an inkjet recording head using the inkjet recording head substrate, an inkjet recording head, an inkjet recording head cartridge and an inkjet recording apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "recording" (also referred to as "print") is not limited to the cases of forming meaningful information such as characters and figures. To be more specific, the "recording" in this specification represents the cases of forming images, designs and patterns broadly on a recording medium or processing the medium whether or not meaningful and whether or not elicited to be visually perceivable by a human being.

The "recording medium" represents not only paper used for a general recording apparatus but also those capable of accepting ink extensively, such as a cloth, a plastic film, a metal plate, glass, ceramics, wood and leather.

Furthermore, "ink" (also referred to as "liquid") should be interpreted extensively as with the definition of the "recording (print)." To be more specific, the "ink" in this specification represents the liquid servable, by being given on the recording medium, for formation of images, designs and patterns, processing of the recording medium or processing of the ink (rendering a coloring material in the ink given to the recording medium coagulated or insoluble for instance).

Furthermore, unless noted in particular, a "nozzle" collectively refers to a discharge opening, a liquid pathway in communication therewith and a device for generating energy used for ink discharge.

An expression "on a device substrate" used in a description does not merely indicate a portion on the device substrate but also indicates a surface of the device substrate and inside of the device substrate near the surface. "Built-in" used in this specification is a word not merely indicating placement of separate devices on the substrate but indicating forming and manufacturing the devices integrally on the device substrate by means of a manufacturing process of semiconductor circuits and so on.

First Embodiment

Figure 17:
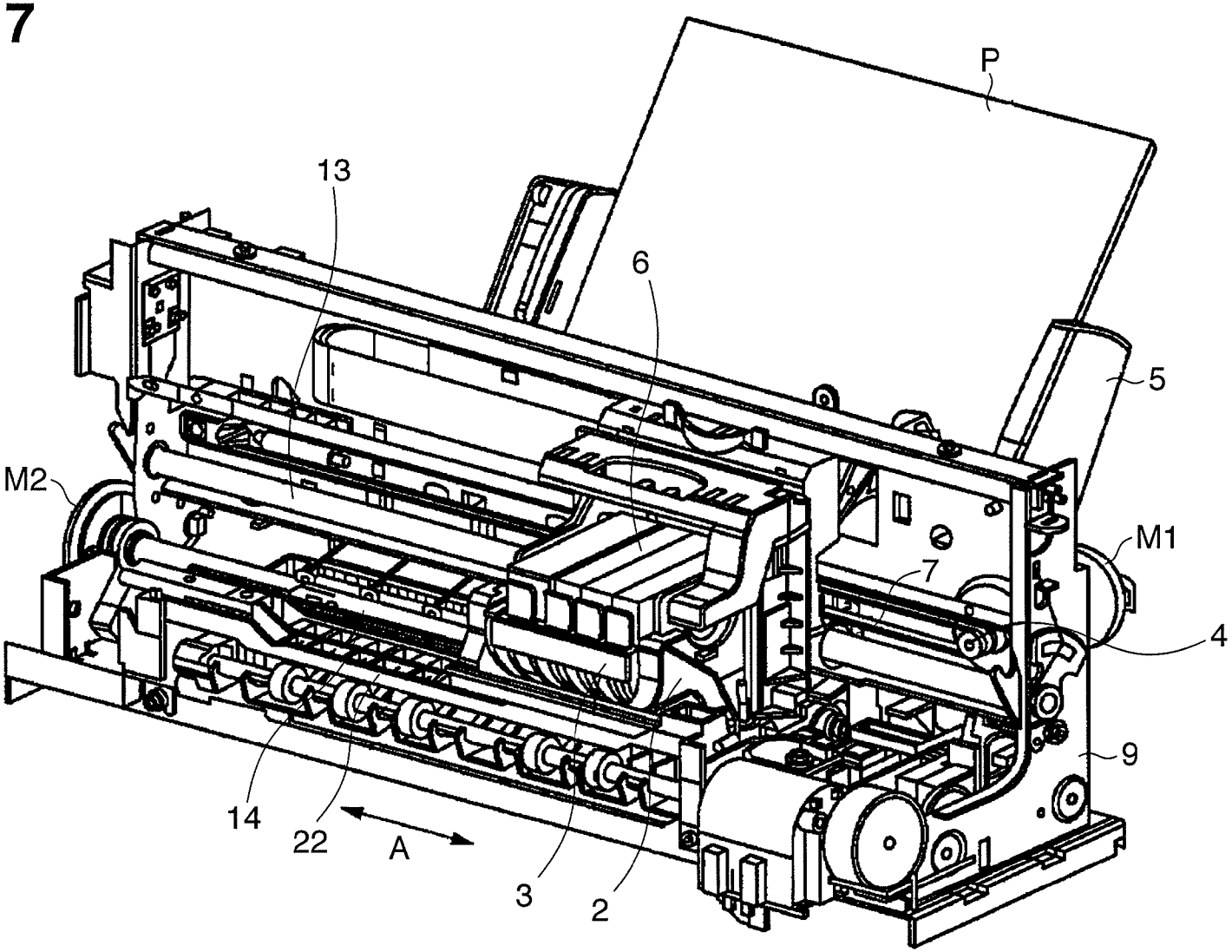
FIG. 17 is a schematic view of an inkjet recording apparatus to which the present invention is applicable.

First, a description will be given as to an example of an inkjet recording apparatus to which the present invention is applicable. FIG. 17 is an outside perspective view showing an overview of a configuration of an inkjet recording apparatus 1 as a representative embodiment of the present invention.

As shown in FIG. 17, the inkjet recording apparatus (hereafter, referred to as the recording apparatus) carries a recording head 3 for performing recording by discharging ink according to an inkjet method to a recording position, where the ink is discharged from the recording head 3 to a recording medium P so as to perform recording. The recording head 3 is carried to the recording position by reciprocating a carriage 2 having the recording head 3 mounted thereon in an arrow A direction and supplying the recording medium P such as recording paper via a feeder 5. The carriage 2 is reciprocated by conveying a driving force generated by a carriage motor M1 from a transfer mechanism 4 to the carriage 2.

To keep the recording head 3 in a good state, the carriage 2 is moved to a position of a recovery apparatus 10 to intermittently perform a discharge recovery process of the recording head 3.

The recording apparatus 1 has not only the recording head 3 but also an ink cartridge 6 for storing the ink to be supplied to the recording head 3 mounted on the carriage 2. The ink cartridge 6 is detachable from the carriage 2.

The recording apparatus 1 shown in FIG. 17 is capable of color recording, and therefor the cartridge 2 has four ink cartridges housing the inks of magenta (M), cyan (C), yellow (Y) and black (K) mounted thereon respectively for that purpose. Each of the four ink cartridges is independently detachable.

The carriage 2 and recording head 3 can achieve and maintain a required electrical connection by having joint surfaces of both the members properly put in contact. The recording head 3 applies energy according to recording signals so as to selectively discharge and record the inks from multiple discharge openings. In particular, the recording head 3 of this embodiment adopts the inkjet method of discharging the ink by using thermal energy, and so it discharges the ink from a corresponding discharge opening by applying a pulse voltage to a corresponding electrothermal transducer according to the recording signal.

Furthermore, in FIG. 17, reference numeral 14 denotes a conveyance roller driven by a conveyance motor M2 for the sake of carrying the recording medium P.

The above-mentioned example has the configuration in which the recording head and the ink cartridge for storing the ink are separable. As will be described below, however, it is also possible to mount a head cartridge having the recording head and ink cartridge integrated therein on the carriage 2.

Figure 18:
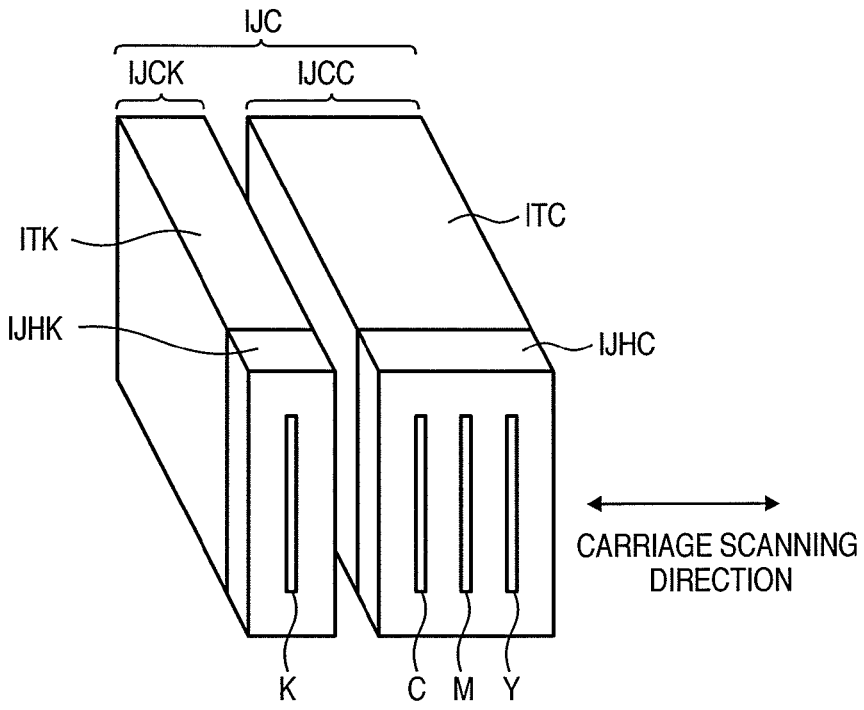
FIG. 18 is an outside perspective view showing a detailed configuration of an inkjet cartridge IJC.

FIG. 18 is an outside perspective view showing an example of a configuration of the head cartridge. In FIG. 17, the ink cartridge 6 and the recording head 3 are separate. It is also possible, however, to apply an inkjet recording head substrate of the present invention to the head cartridge having the ink cartridge and recording head integrated therein.

As shown in FIG. 18, an inkjet cartridge IJC is configured by a cartridge IJCK for discharging the black ink and a cartridge IJCC for discharging the inks in three colors of cyan (C), magenta (M) and yellow (Y). These two cartridges are mutually separable and independently detachable from the carriage 2 respectively.

The cartridge IJCK consists of an ink tank ITK for storing the black ink and a recording head IJHK for discharging the black ink and performing recording, where they have an integral configuration. Likewise, the cartridge IJCC consists of an ink tank ITC for storing color inks of the three colors of cyan (C), magenta (M) and yellow (Y) and a recording head IJHC for discharging the color inks and performing recording, where they have the integral configuration. According to this embodiment, the cartridges have the inks filled in the ink tanks.

Furthermore, as is evident in FIG. 18, a nozzle row for discharging the black ink, a nozzle row for discharging the cyan ink, a nozzle row for discharging the magenta ink and a nozzle row for discharging the yellow ink are placed alongside in a carriage moving direction. The nozzle array direction is the direction intersecting with the carriage moving direction.

Figure 19:
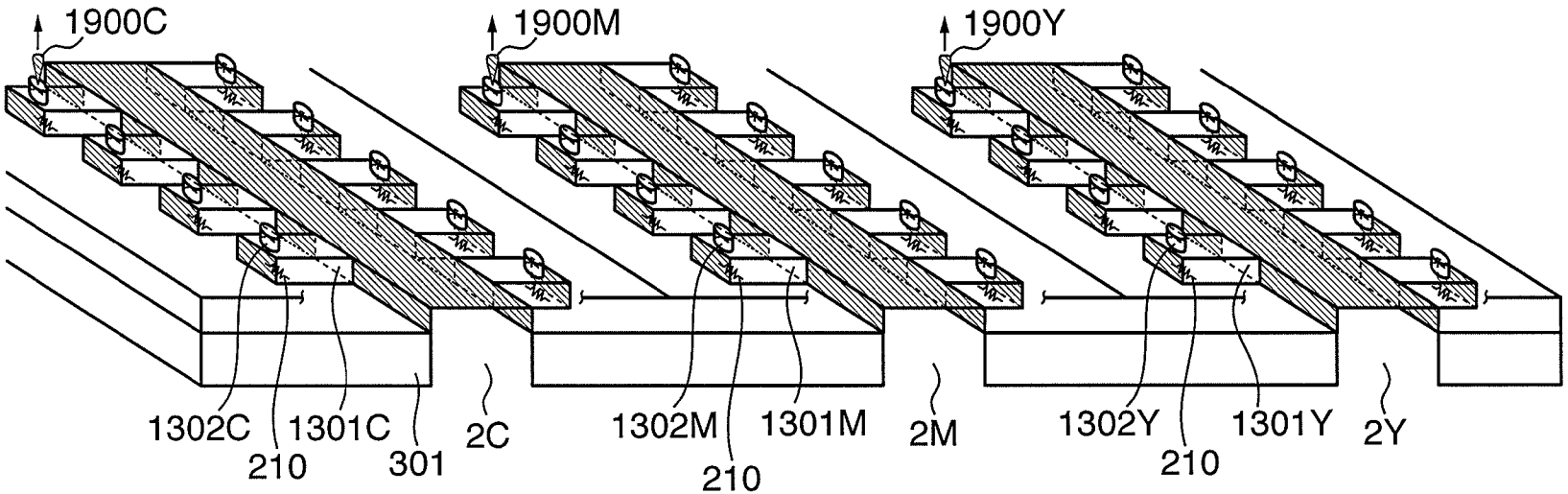
FIG. 19 is a perspective view showing a three-dimensional structure of a recording head IJHC for discharging inks in three colors.

Next, a description will be given as to the head substrate used for the recording head 3 of the recording apparatus configured as above. FIG. 19 is a perspective view showing a three-dimensional structure of the recording head IJHC for discharging the inks in three colors.

FIG. 19 clarifies a flow of the ink supplied from the ink tank ITC. The recording head IJHC has an ink channel 2C for supplying the cyan (C) ink, an ink channel 2M for supplying the magenta (M) ink and an ink channel 2Y for supplying the yellow (Y) ink. It also has supply routes (not shown) for supplying from a backside of the substrate the respective inks from the ink tank ITC to the respective ink channels.

By way of the ink channels, the cyan (C), magenta (M) and yellow (Y) inks are led to electrothermal transducers (heaters) 210 provided on the substrate by ink passages 1301C, 1301M and 1301Y. If a current is passed through the electrothermal transducers (heaters) 210 through the circuit described later, the inks on the electrothermal transducers (heaters) 210 get heated and come to a boil. Consequently, ink droplets 1900C, 1900M and 1900Y are discharged from discharge openings 1302C, 1302M and 1302Y by generated bubbles.

In FIG. 19, reference numeral 301 denotes the head substrate having the electrothermal transducers described in detail later and various circuits for driving them, various pads as electrical contacts with a memory and a carriage HC and various signal lines formed thereon.

One electrothermal transducer (heater), a MOS-FET for driving it and the electrothermal transducers (heaters) are collectively called a recording device, and multiple recording devices are generically named a recording device portion.

FIG. 19 shows the three-dimensional structure of the recording head IJHC for discharging the color inks. The recording head IJHK for discharging the black ink also has the same structure. However, the structure is one third of the configuration shown in FIG. 19. To be more specific, it has one ink channel, and the scale of the head substrate is about one third or so.

Figure 20:
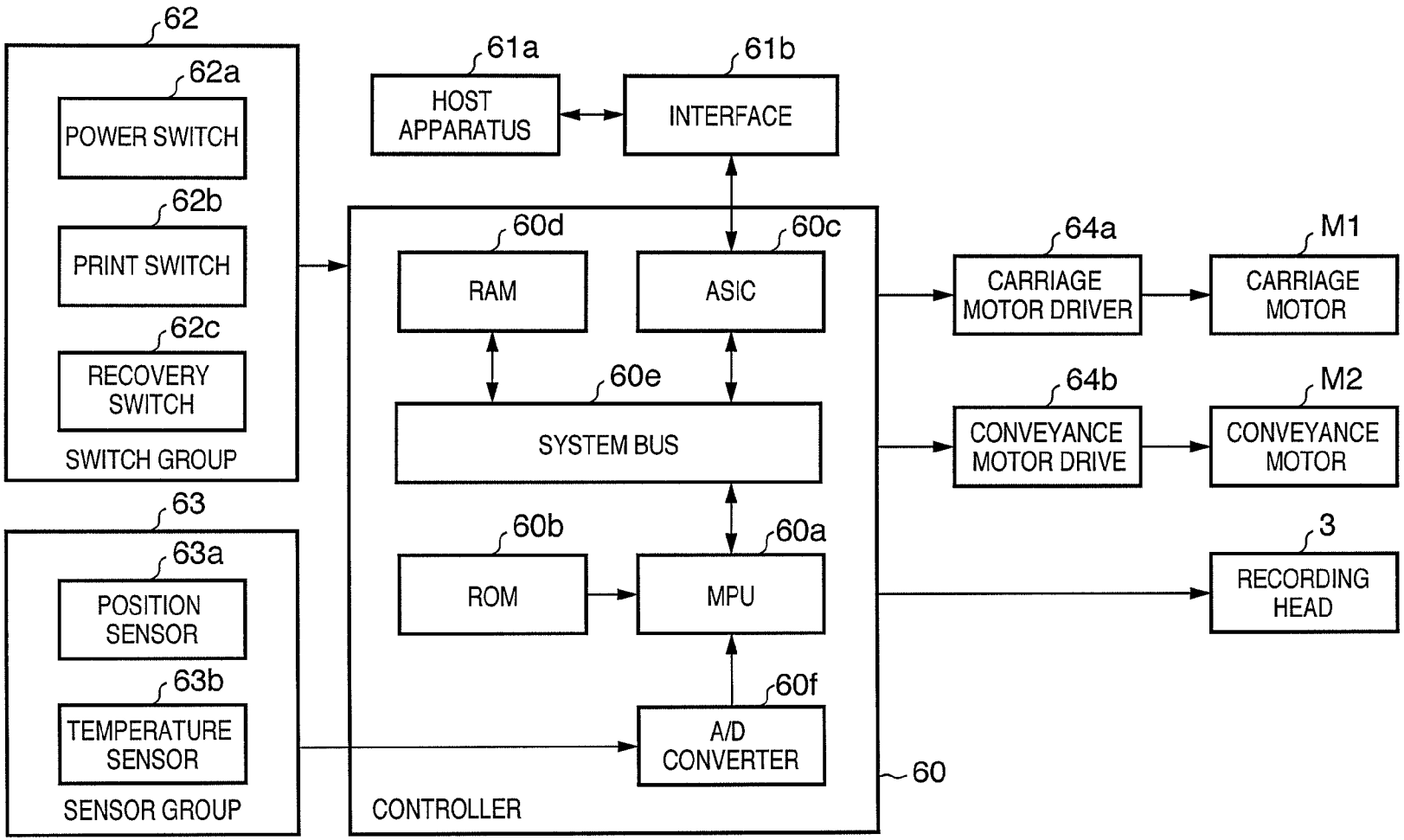
FIG. 20 is a diagram showing a control configuration for performing recording control of the inkjet recording apparatus shown in FIG. 17.

Next, a description will be given as to a control configuration of the inkjet recording apparatus. FIG. 20 is a block diagram showing the control configuration of the recording apparatus shown in FIG. 17.

As shown in FIG. 20, a controller 60 is configured by an MPU 60*a*, an ROM 60*b* storing a program corresponding to a control sequence described later, a required table and other fixed data, an application specific integrated circuit (ASIC) 60*c* for generating control signals for controlling a carriage motor M1, controlling a conveyance motor M2 and controlling the recording head 3, an RAM 60*d* having an image data expansion area and a work area for program execution, a system bus 60*e* for mutually connecting the MPU 60*a*, ASIC 60*c* and RAM 60*d* and sending and receiving the data, and an A/D converter 60*f* for inputting and A/D-converting analog signals from a sensor group described below to supply digital signals to the MPU 60*a*.

In FIG. 20, a reference character 61*a* denotes a computer (or a reader or a digital camera for reading an image) as a supply source of image data, which is generically named a host apparatus. The image data, commands and status signals are transmitted and received between the host apparatus 61*a* and the recording apparatus 1 via an interface (I/F) 61*b*.

Furthermore, a reference numeral 62 denotes a switch group which is configured by the switches for receiving order inputs by an operator, such as a power switch 62*a*, a print switch 62*b* for ordering a start of printing and a recovery switch 62*c* for ordering a start of a process (recovery process) for keeping ink discharge performance of the recording head 3 in good condition. Reference numeral 63 denotes a sensor group for detecting an apparatus state, configured by a position sensor 63*a* such as a photo coupler for detecting a home position h, a temperature sensor 63*b* provided at an appropriate location of the recording apparatus for the sake of detecting an ambient temperature.

Furthermore, a reference character 64*a* denotes a carriage motor driver which drives the carriage motor M1 for having a reciprocating scan performed by the carriage 2 in the arrow A direction, and 64*b* denotes a conveyance motor driver which drives the conveyance motor M2 for carrying the recording medium P.

On record scanning by the recording head 3, the ASIC 60*c* transfers driving data (DATA) of the recording device (heater) to the recording head while directly accessing a storage area of the RAM 60*d*.

Next, a detailed description will be given as to the head substrate (device substrate) used for the recording head of the recording apparatus configured as above. In particular, a description will be given centering on the configuration of the drive circuit built on the head substrate (heater board). As described above, the head substrate has the members (not shown) forming the ink discharge openings 1302C, 1302M and 1302Y and the ink channels 2C, 2M and 2Y in communication with the discharge openings provided thereon correspondingly to the recording devices, which configure the recording head. The ink supplied to the recording device is heated by driving the recording device to generate air bubbles by film boiling so as to discharge the ink from the discharge opening.

Figure 7:
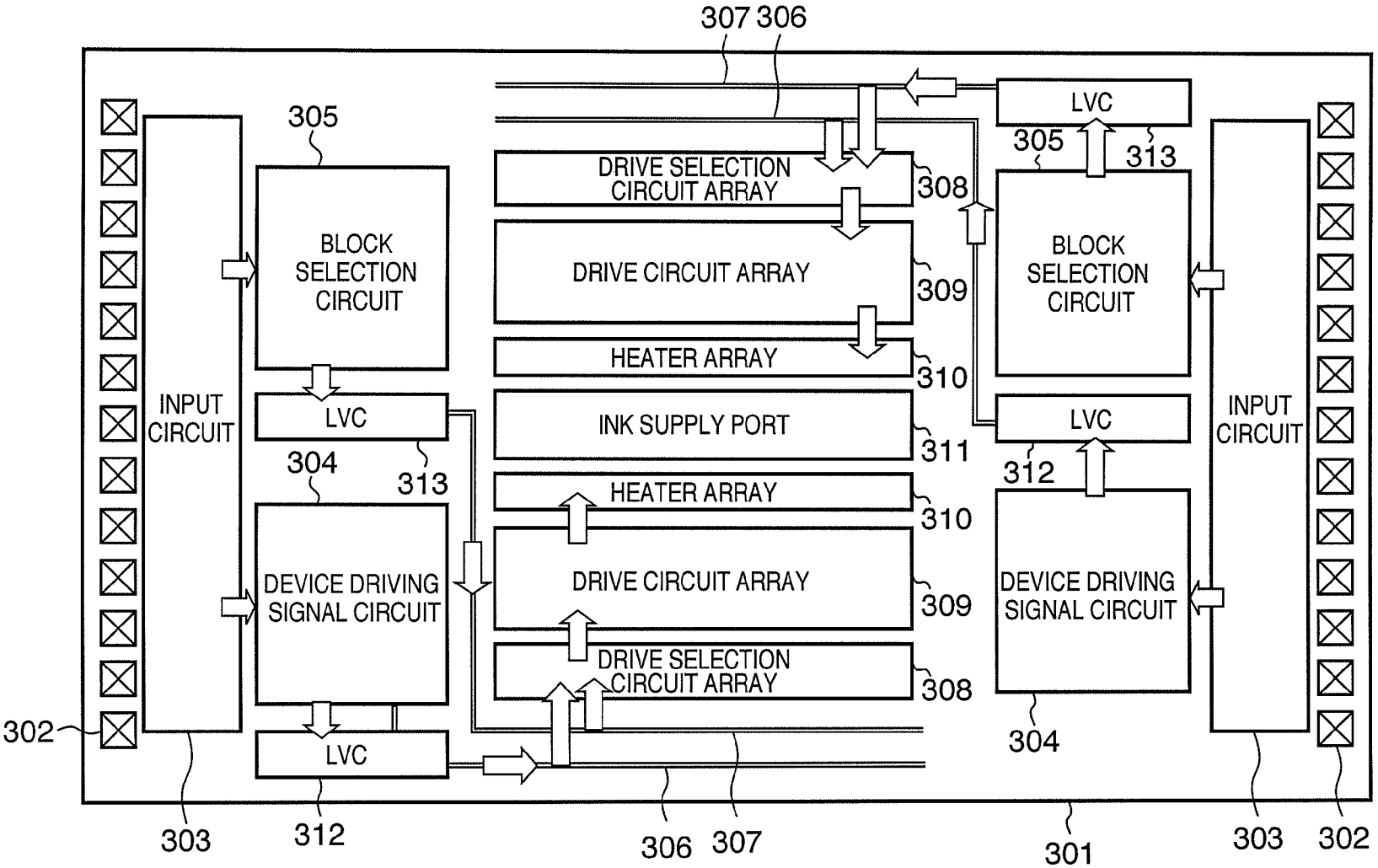
FIG. 7 is a circuit block diagram of the inkjet recording head semiconductor substrate of a first embodiment and a schematic diagram showing a flow of an electrical signal.

FIG. 7 is a circuit block diagram schematically showing the circuit configuration of the head substrate 301 and the flow of an electrical signal according to the first embodiment. In FIG. 7, the head substrate 301 is the substrate having the heaters and drive circuits integrally built in by a semiconductor process technology, and is equivalent to the above-mentioned head substrate 1705. As shown in FIG. 7, the substrate 301 has the circuit blocks placed symmetrically centering on an ink supply port 311. This circuit block includes a heater array 310, a drive circuit array 309, a drive selection circuit array 308, a device driving signal circuit 304 and a block selection circuit 305. The heater arrays 310 are provided across the ink supply port 311, and are configured by multiple heaters. The drive circuit array 309 is configured by the drive circuits for passing the current through the heaters. The drive selection circuit array 308 is the circuit for controlling the drive circuits. The device driving signal circuit 304 and block selection circuit 305 generate the signals to be transmitted to the drive selection circuit array 308. An input circuit 303 processes the signals inputted from a pad 302. These circuit blocks are placed symmetrically to the ink supply port 311, and so common reference numerals are given to the symmetrically placed blocks. Hereunder, a description will be given as to the functions and signal flows of these blocks.

Figure 6:
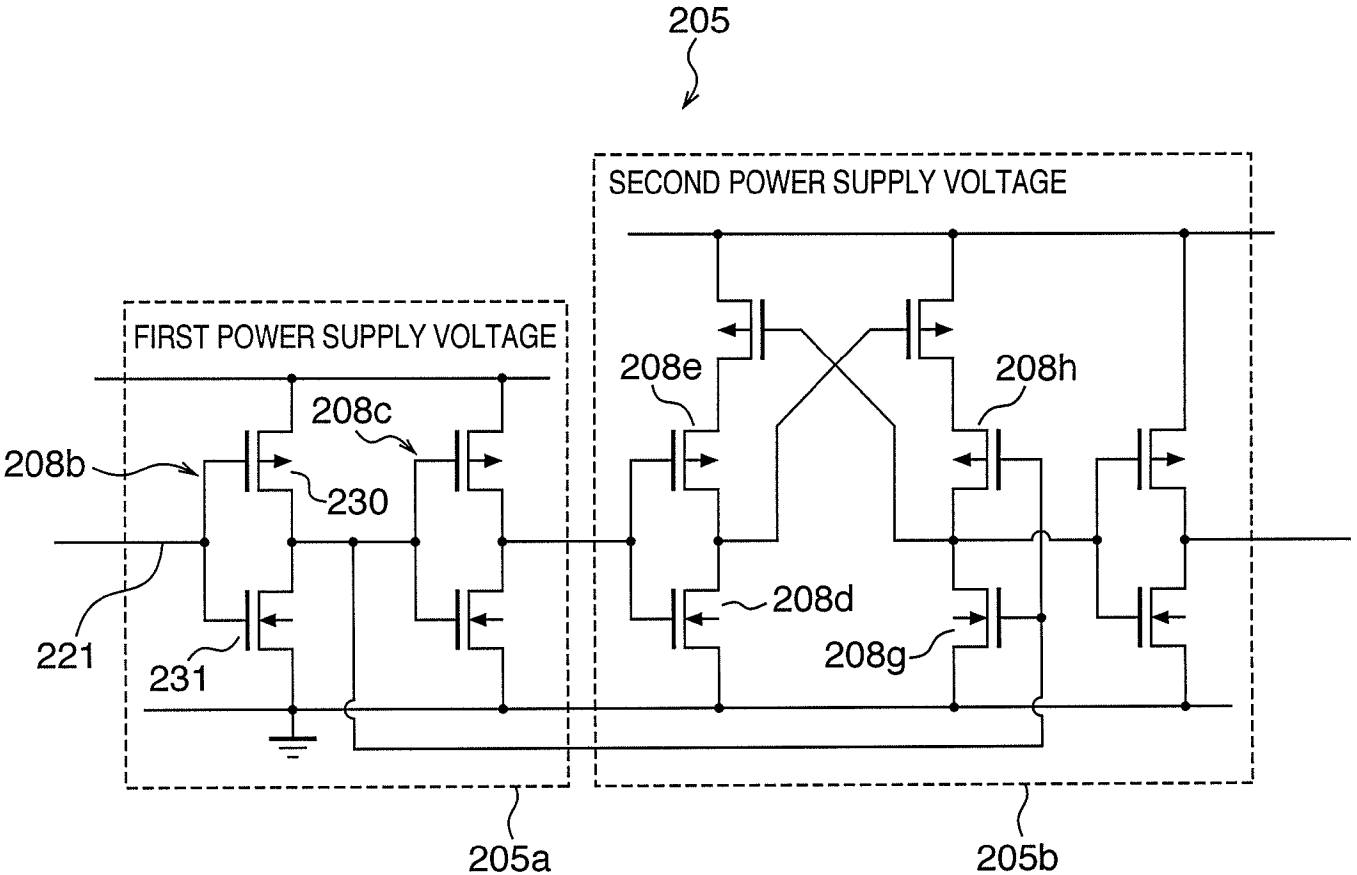
FIG. 6 is a diagram showing a circuit configuration example of a general level conversion circuit.

The head substrate 301 is a silicon substrate on which the circuit blocks and the heaters for heating the ink are formed by using an LSI process. The power supply voltage and signals inputted from the pads 302 for inputting and outputting image data are transmitted to the device driving signal circuit 304 and block selection circuit 305 via the input circuit 303. The block selection circuit 305 generates a block selection signal for selecting the block to be driven based on the inputted signal. The device driving signal circuit 304 generates a time division selection signal for driving each heater in a selected block according to the image data based on the inputted signal. The time division selection signal and block selection signal are supplied to level conversion circuits 312 and 313 respectively. The level conversion circuits 312 and 313 shift a level of the inputted signal to a signal of a power supply voltage amplitude larger than an inputted signal amplitude. A circuit configuration example of the level conversion circuit is as shown in FIG. 6. The time division selection signal and block selection signal outputted from the level conversion circuits 312 and 313 are led to a heater alignment direction by bus lines 306 and 307 consisting of multiple lines.

The time division selection signal and block selection signal from the bus lines 306 and 307 are connected to the drive selection circuits which are the components of the drive selection circuit array 308 respectively. On and off of the drive selection circuits are decided by the signals from the bus lines 306 and 307. When performing a discharge operation of the ink, the signal of the bus line for turning on the desired drive selection circuit is applied, and the signal is outputted from the drive selection circuit to turn on a corresponding drive circuit. The drive circuit having become on passes the current to the corresponding heater so that the heater gets heated by the passing current and the ink foaming and discharge operation is performed.

Figure 8:
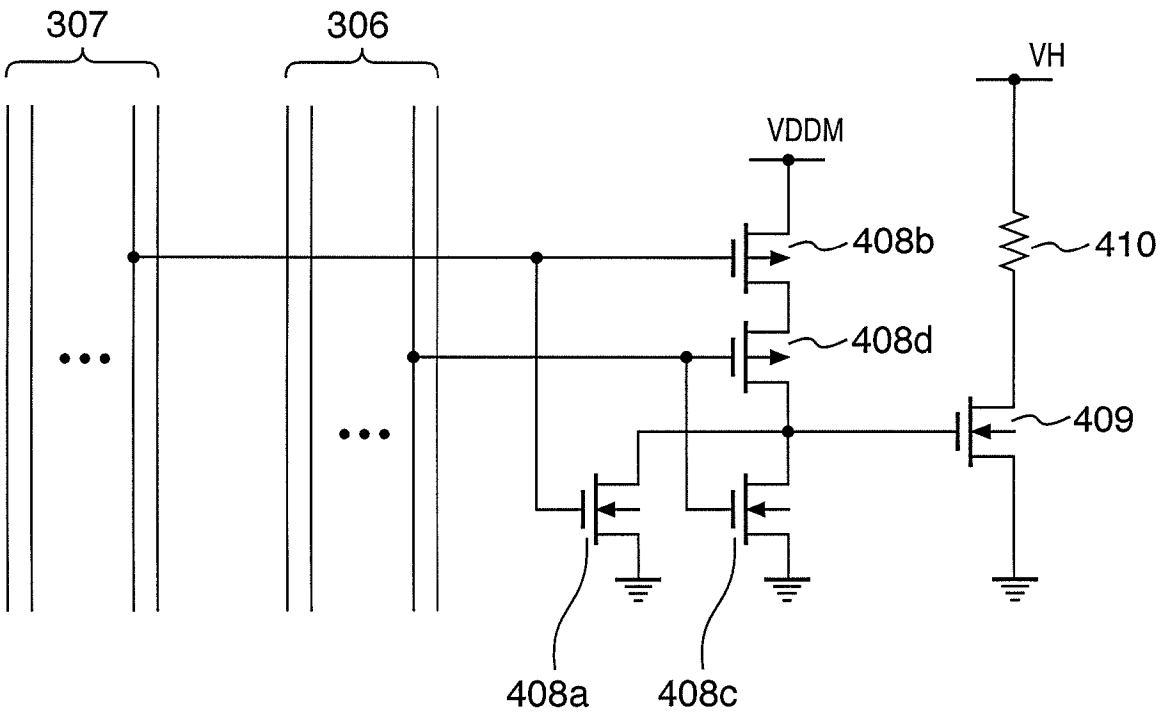
FIG. 8 is a diagram showing the drive circuit per segment of the inkjet recording head semiconductor substrate of the first embodiment.

FIG. 8 is a circuit diagram showing the drive selection circuit and drive circuit corresponding to an arbitrary heater in the heater arrays 310 extracted from the above-mentioned drive selection circuit array 308 and drive circuit array 309.

As described above, the output signals from the device driving signal circuit 304 and block selection circuit 305 are level-shifted by the level conversion circuits 312 and 313 so as to have the signal amplitude of a voltage VDDM higher than VDD which is an input signal amplitude. The bus lines 306 and 307 lead the signals having the signal amplitude of the voltage VDDM.

Circuit elements 408*a* to 408*d* are the devices of a high withstand voltage for operating at a VDDM potential respectively, and configure the drive selection circuit (NOR gate) corresponding to one heater in the drive selection circuit array 308. The output of the NOR gate is connected to the gate of an NMOS transistor 409 which is the drive circuit for exerting on and off control of the heaters. This segment becomes on by the operation of the following flow.

First, the output signal from the device driving signal circuit 304 and block selection circuit 305 have their output signal amplitude level-converted to VDDM by the level conversion circuits 312 and 313. Here, the output signals from the device driving signal circuit 304 and block selection circuit 305 output to the bus lines the VDDM potential which is a Hi level in the case of not selecting the corresponding devices and blocks, and output to the bus lines 0 V which is a Lo level in the case of selecting them.

Therefore, in the case of an unselected segment, at least one of the signals inputted to the NOR gate from the bus lines 306 and 307 is the VDDM potential. As the VDDM potential is inputted to at least one of the inputs to the NOR gate, its output potential becomes 0 V, the transistor 409 is not turned on and no heater current passes. When both the input signals from the bus lines 306 and 307 become 0 V, the output of the NOR gate becomes the VDDM potential. Consequently, the transistor 409 becomes on-state, and the heater current is passed from a heater power supply potential VH via a heater 410. The heater having the current passed generates the heat required for the ink foaming and discharge.

The output from the NOR gate becomes Hi only in the case where all the input signals thereof become 0 V. For that reason, the NOR gate can singly control the heater current driving NMOS transistor 409. In the case of using the NAND gate, the output becomes Lo only in the case where all the input signals to the NAND gate become Hi (VDDM). For this reason, to control the heater current driving NMOS transistor with a result of calculation by the NAND gate, it becomes necessary to further insert an inverter for performing an NOT calculation so that the number of devices per segment increases. Therefore, it can be an impediment when placing the selection circuit in high density.

To be more specific, when a 2-input NOR gate has both the output signals from the device driving signal circuit 304 and block selection circuit 305 at the Lo level, the output signal of a 2-input NOR circuit 408 becomes Hi-level so that the output is directly applied to the gate of the NMOS transistor 409 to turn on the NMOS transistor 409.

The case of replacing the 2-input NOR with a 2-input NAND is assumed.

When selecting an arbitrary device with the signals from the device driving signal circuit and block selection circuit by means of the 2-input NAND, Hi signals are inputted as the signals to the NAND circuit from the device driving signal circuit and block selection circuit. To be more specific, Lo is outputted as the output signal of the NAND circuit for the first time when both the signals from the device driving signal circuit and block selection circuit become Hi. Here, in the case where one or both of the signals from the device driving signal circuit and block selection circuit become Lo, the output signal of the NAND circuit becomes Hi and the relevant NAND circuit is not put in a selection state.

In this case, the output signal of the NAND circuit is Lo in the selection state. Even if the output signal is directly applied to the gate of the heater driving NMOS transistor to output Lo in the selection state, it cannot be turned on in the selection state. To turn it on in the selection state, it becomes necessary to insert an NOT circuit (inverter) between the output of the NAND circuit and the heater driving NMOS transistor.

Thus, in the case of inputting the selection signal of Hi to the NAND circuit, it is necessary to insert the NOT circuit between the NAND circuit and the heater driving NMOS transistor. According to this embodiment for inputting the selection signal of Lo to the NOR circuit, it is possible to apply the output signal of the NOR circuit directly to the heater driving NMOS transistor so as to control the heater current. It is also possible to eliminate the NOT circuit which is necessary in the NAND circuit configuration so as to realize the configuration with s smaller number of devices.

When driving the heater driving NMOS transistor here, the higher the voltage applied as its driving voltage is, the larger the passable heater current becomes. Therefore, it is desirable to configure the NOR circuit with the MOS transistor of a high withstand voltage. To be more specific, it is desirable, as for the NMOS transistor, to use the transistor of the same configuration as the heater driving NMOS transistor so as to allow a high power supply voltage to be controlled.

The NMOS transistor 409 is used for heater current driving because, as the NMOS transistor generally uses an electron of higher mobility than a hole as a carrier, its on-resistance per area can be lower than that of the PMOS transistor. To be more specific, the on-resistance is reduced by using a field-effect transistor having a channel of which carrier is the electron on the drive circuit of the heater.

Furthermore, the heater driving transistor controls a large current because it needs to generate the heat required for the ink discharge with the heater. In many cases, the MOS transistor takes the structure of a power MOS transistor. There are various structures of the power MOS transistor. However, the general large-current control power MOS transistor uses the MOS transistor of a double diffusion structure (DMOS transistor) of which substrate potential is a source or a drain.

Figure 21:
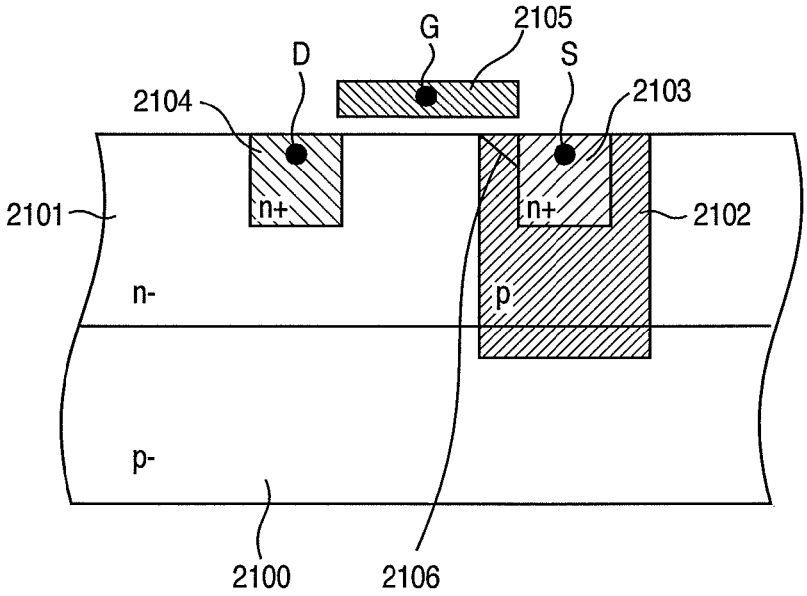
FIG. 21 is a sectional model view of a MOS transistor of a lateral double diffusion structure.

The transistor of the double diffusion structure will be described as to the case of the NMOS transistor for performing current control with an N-type channel. FIG. 21 shows a sectional model view of the MOS transistor of a lateral double diffusion structure.

Here, an n-diffused layer 2101 is formed on a p-type silicon substrate 2100. A p-type diffused layer 2102 is further diffused and formed to a depth reaching the p-type silicon substrate 2100 in the n-diffused layer 2101. n+layers 2103 and 2104 are diffused and formed at the position opposed to the diffused and formed 2102 across a gate electrode 2105.

Here, reference numeral 2104 denotes a drain and 2103 denotes a source electrode.

If a positive potential is applied to the gate electrode 2105 in the state of applying the voltage between the source electrode and the drain electrode, the channel is formed and the current passes in an area indicated by reference numeral 2106 (channel forming area 2106).

The transistor of this structure needs to be driven with a potential difference of approximately 0 between the source electrode and a p-type diffused layer 2106 in which the channel is formed.

It is because, as the n+layer 2103 and p-diffused layer 2102 are impurity diffused layers of a relatively high high-impurity concentration, it is difficult to sufficiently secure reverse withstand resistance of a p-n junction.

It is necessary to drive such a DMOS transistor with the withstand resistance between the source and the substrate as the same potential.

In the case of configuring the selection circuit by using this DMOS transistor, it is possible, in the case of the NOR circuit, to set the source potential of both the NMOS transistors as the substrate potential as shown in FIG. 8. On the other hand, to configure the NAND circuit, it is necessary to connect the two NMOS transistors in series between an output node and the substrate potential, and so the source potential of one NMOS cannot be fixed as the substrate potential.

It becomes possible to decrease the number of devices and reduce the layout area by using the NOR circuit as the circuit for driving the gate of the NMOS transistor 409. It is also possible to have the configuration for fixing the source potential as the substrate potential by configuring the NOR with the DMOS of a high withstand resistance.

Figure 5:
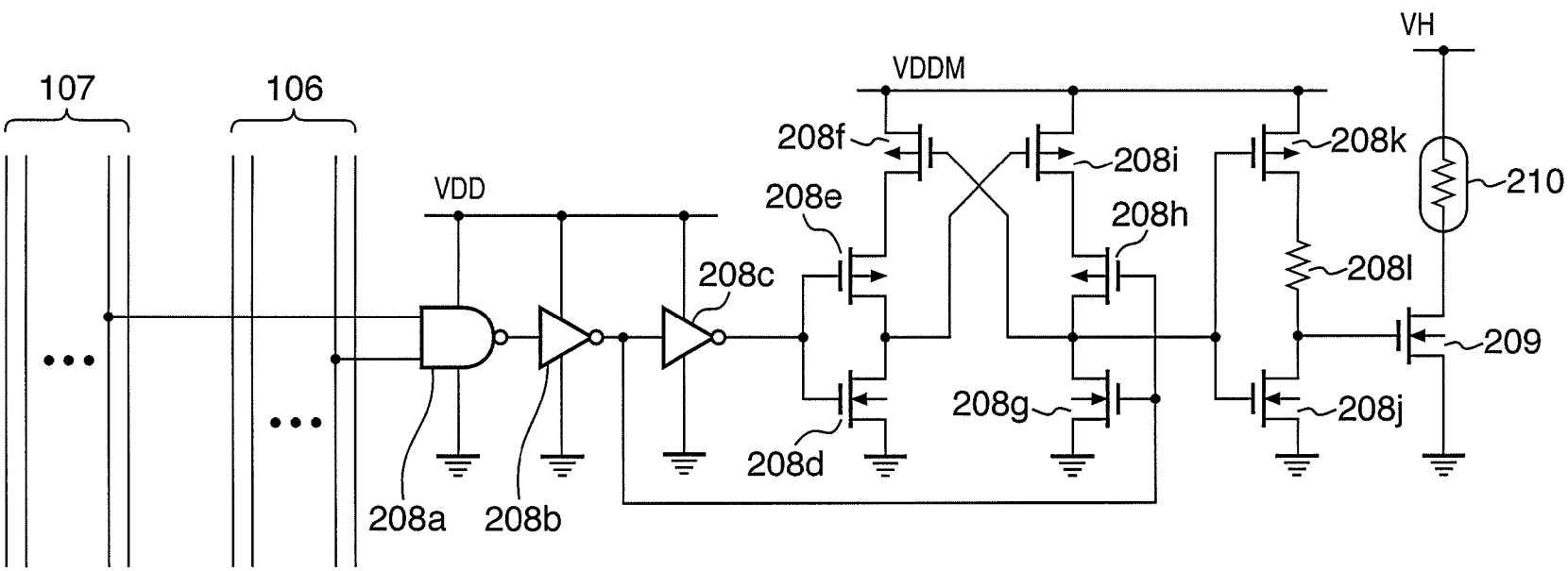
FIG. 5 is a diagram showing the drive circuit per segment of a general inkjet recording head semiconductor substrate.

Furthermore, the circuit shown in FIG. 8 is the NOR gate by means of CMOS (Complementary MOS transistor) and includes the configuration having the PMOS transistors connected in series. To be more specific, as shown in FIG. 8, the NOR gate is formed by a CMOS structure with a PMOS transistor 408*b* and an NMOS transistor 408*a* and the CMOS structure with a PMOS transistor 408*d* and an NMOS transistor 408*c*. And the PMOS transistor 408*b* and PMOS transistor 408*d* are further connected in series. It is possible, because of this configuration, to obtain the function of the resistance 208*l* described in FIG. 5, that is, the effect of rendering a precipitous rising edge of the heater current moderate. To be more specific, the PMOS transistors configuring the NOR gate are connected in series from the power supply potential to the output node. For this reason, the on-resistance on changing the output from Lo to Hi can be higher than the case of using the inverter consisting of the PMOS and NMOS transistors of the same gate width and gate length (the inverter formed by PMOS transistor 208*k* and NMOS transistor 208*j* of FIG. 5). The precipitous rising edge of the heater current is alleviated by the on-resistance due to the PMOS transistors 408*b* and 408*d* connected in series and a time constant of the gate capacity of the heater driving transistor 409 so as to allow a malfunction due to noise to be curbed. To be more specific, it is possible, in FIG. 5, to eliminate the resistance 208*l* placed for the purpose of alleviating the precipitous rising edge of the current, or to replace the resistance 208*l* with a low-resistance device having a smaller device area so as to allow high-density placement of drive control circuits.

As described above, according to the first embodiment, it is possible to decrease the number of devices of a high withstand resistance placed on each segment so as to place the circuits required for the head substrate 301 at a high density without an increase in chip size. It is also possible to achieve a high-density heater placement by placing the heaters correspondingly to heater selection circuits placed at a high density. To be more specific, it is possible to provide the circuit configuration capable of selectively driving the heaters placed at a high density therein without an increase in chip size.

Second Embodiment

According to the first embodiment, the level conversion circuits 312 and 313 are connected to the outputs of the device driving signal circuit 304 and block selection circuit 305 respectively. As for a second embodiment, a description will be given as to a configuration for connecting the level conversion circuits to the input sides of the device driving signal circuit and block selection circuit.

Figure 9:
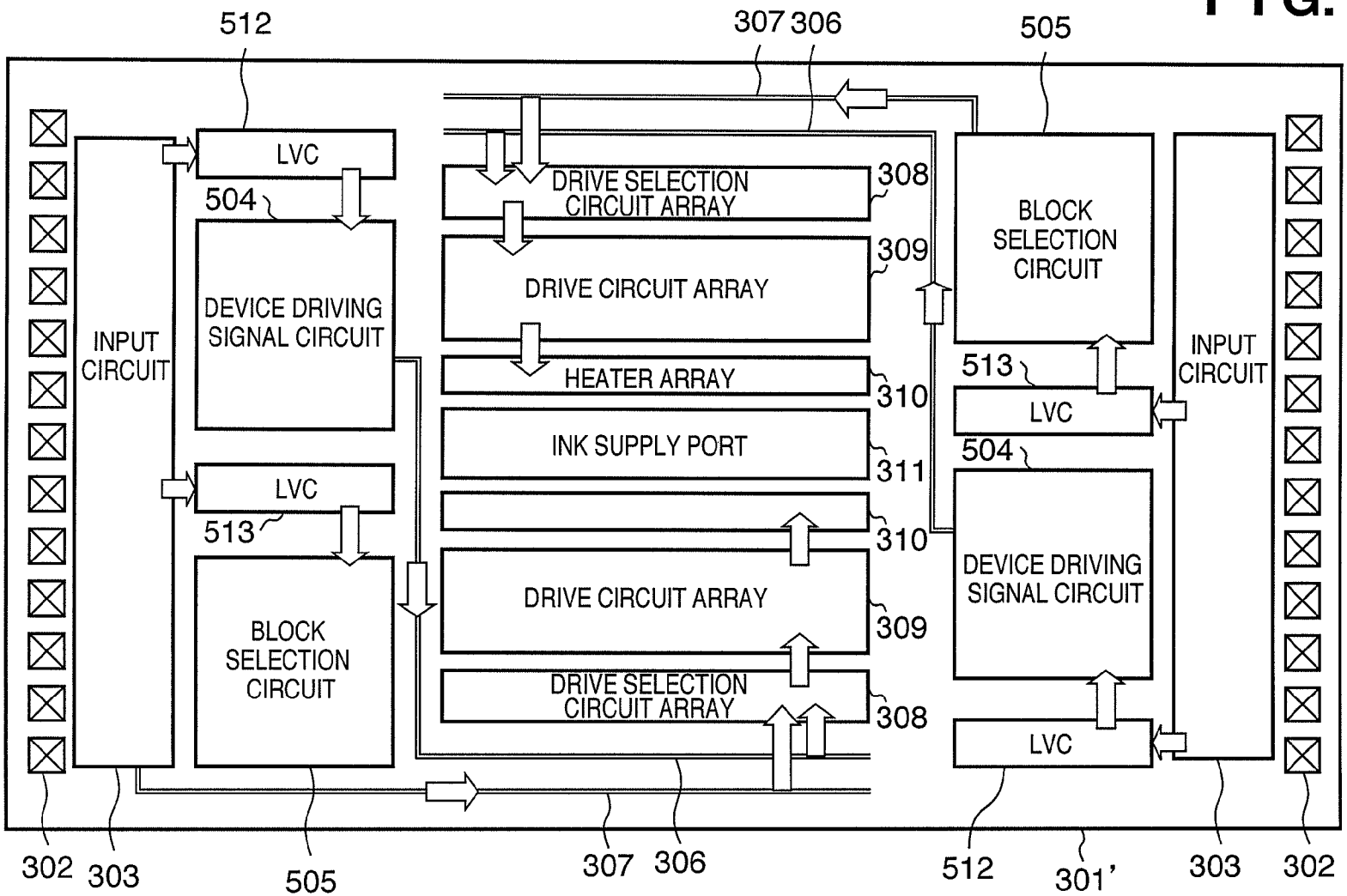
FIG. 9 is a circuit block diagram of the inkjet recording head semiconductor substrate of a second embodiment and a schematic diagram showing a flow of the electrical signal.

FIG. 9 is a circuit block diagram schematically showing a circuit configuration example and a flow of the electrical signal of a head substrate 301' according to the second embodiment. The circuit block shown in FIG. 9 is placed symmetrically centering on the ink supply port 311 as with the first embodiment. The elements configuring this circuit block are the heater array 310 consisting of multiple heaters across the ink supply port 311, the drive circuit array 309 for passing the current through the heaters, the drive selection circuit array 308 for controlling the drive circuit, a device driving signal circuit 504 and a block selection circuit 505 for generating the signals to be transmitted to the drive selection circuit array, and the input circuit 303 for processing the signals inputted from the pads 302.

The second embodiment is different from the first embodiment as to insertion positions of the level conversion circuits for converting a first power supply voltage amplitude of the same voltage amplitude as the input signal to a second power supply voltage amplitude which is higher. According to the second embodiment, level conversion circuits 512 and 513 are connected to the output side of the input circuit 303, and the device driving signal circuit 504 and block selection circuit 505 are connected to a subsequent stage of the level conversion circuits 512 and 513. According to the first embodiment, the device driving signal circuit 304 and block selection circuit 305 operate at the first power supply voltage (VDD), and the level conversion circuits 312 and 313 are inserted to convert the signal amplitude to the second power supply voltage (VDDM) as to the output signals from these circuits. According to the second embodiment, the level conversion circuits 512 and 513 are inserted to convert the signal amplitude to the second power supply voltage (VDDM) as to the output signals from the input circuit 303 while the device driving signal circuit 504 and block selection circuit 505 operate at the second power supply voltage (VDDM).

Figure 10:
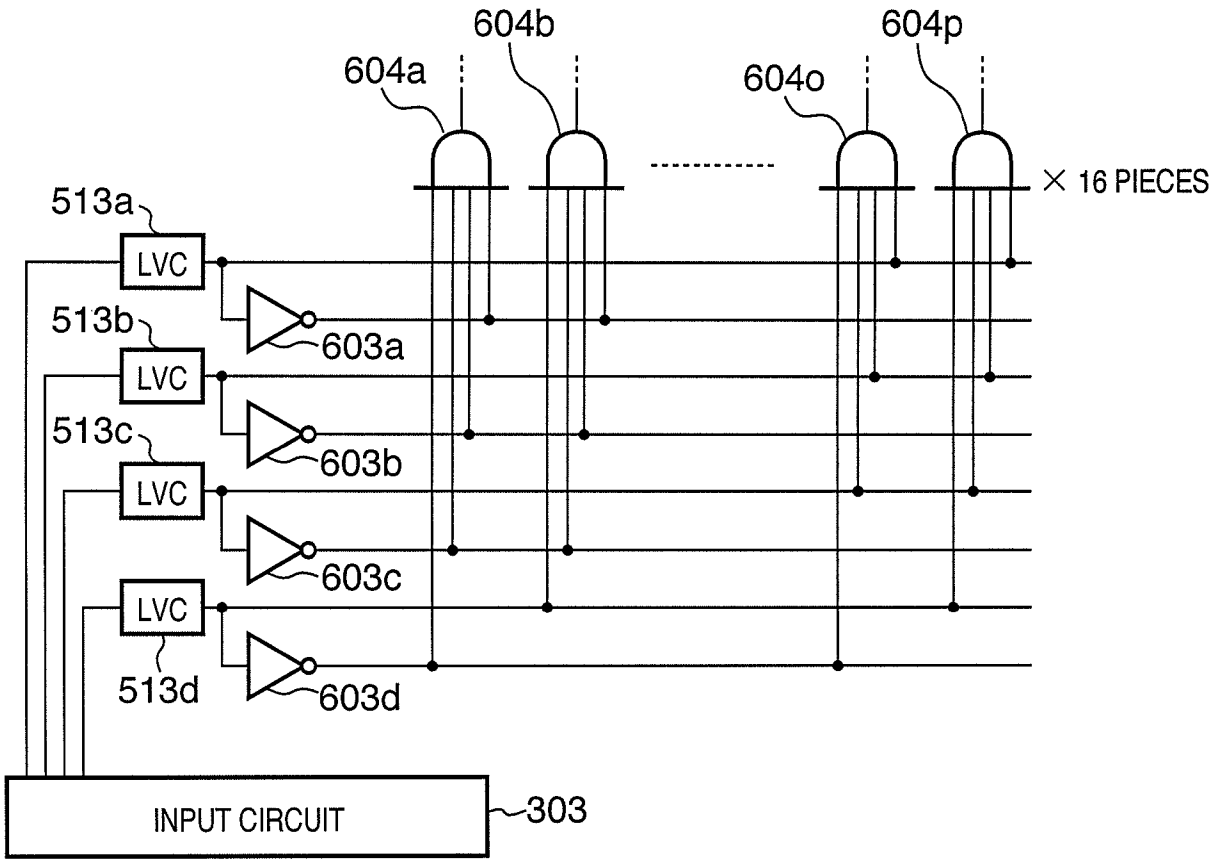
FIG. 10 is a diagram showing a block selection circuit of the inkjet recording head semiconductor substrate of the second embodiment.
Figure 11:
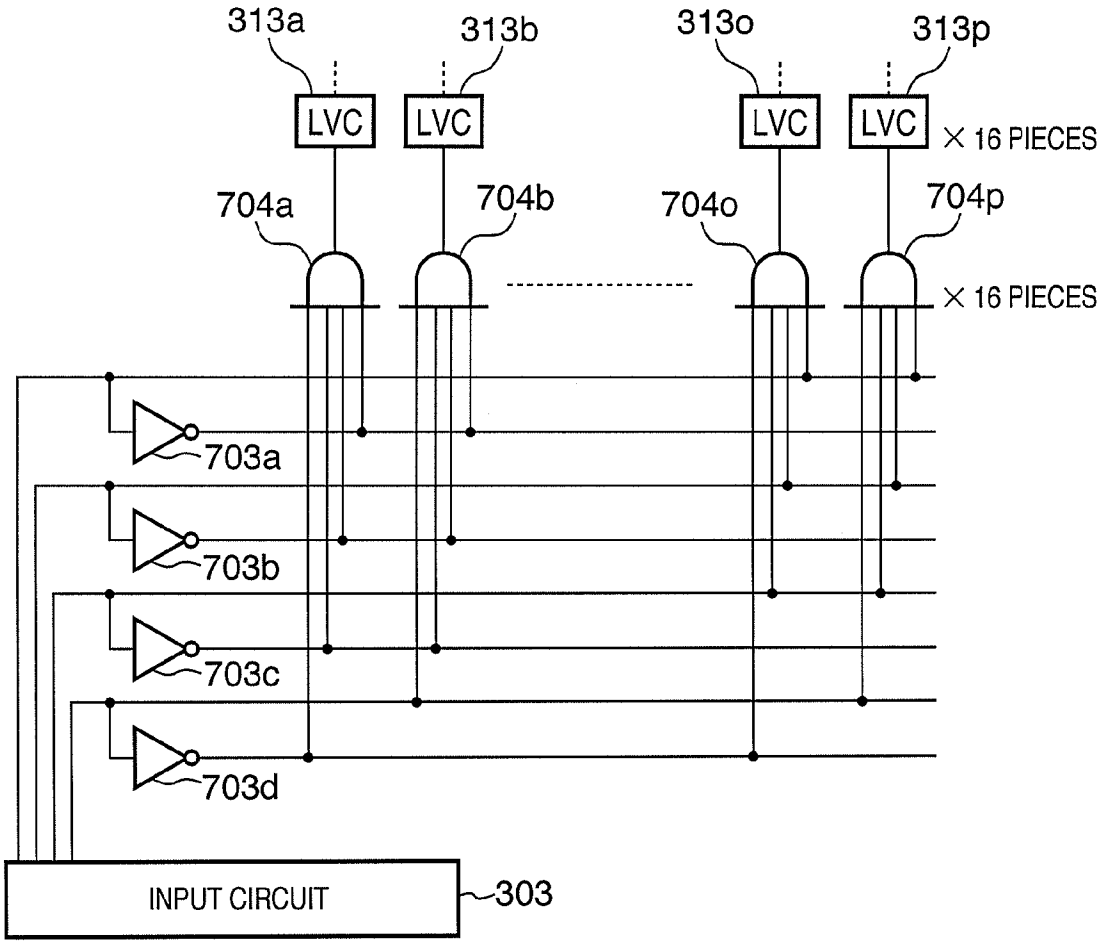
FIG. 11 is a diagram showing the block selection circuit of the inkjet recording head semiconductor substrate of the first embodiment.

It is possible, by adopting such a configuration of the second embodiment, to curb the scale of the level conversion circuit of which layout area becomes larger, for instance, in the case where the block selection circuit is a decoder for expanding the input signals. For instance, consideration is given to the case where the selection circuit has the decoder which selects one of sixteen signal lines from 4-bit input signals and outputs the signal. FIG. 10 shows the circuit configuration of the level conversion circuit 513 and block selection circuit 505 of the second embodiment. FIG. 11 shows the circuit configuration of the level conversion circuit 313 and block selection circuit 305 of the first embodiment.

To select an arbitrary line out of the sixteen bus lines by means of the 4-bit input signals, it is necessary to connect Hi/Lo logics of the four input signals to sixteen 4-input AND gates so that the Hi/Lo logics of the four input signals become mutually different. The decoder of the second embodiment connects the 4-bit input signals to four level conversion circuits 513*a* to 513*d* from the output of an input circuit 601. The output and the signals having their logics inverted by inverters 603*a* to 603*d* are connected to sixteen AND gates 604*a* to 604*p* so that they become different from one another. Here, the output voltage of the level conversion circuits 513*a* to 513*d* is the second power supply voltage higher than the first power supply voltage which is the power supply voltage of the input signal. For that reason, the inverters 603*a* to 603*d* and the AND gates 604*a* to 604*p* operate at the second power supply voltage. Because of such a configuration, there are the four level conversion circuits to be placed.

For convenience sake, FIG. 10 is the circuit diagram using the AND gates 604*a* to 604*p*. As previously described, however, it is desirable to configure the AND gates 604*a* to 604*p* of FIG. 10 with the NOR gates for inputting a negative logic.

On the other hand, the configuration of the first embodiment shown in FIG. 11 operates up to the block selection circuit 305 at the first power supply voltage. For that reason, it is necessary to provide level conversion circuits 313*a* to 313*p* to each of the sixteen bus lines as the outputs of the block selection circuit 305, that is, to each output of sixteen AND gates 704*a* to 704*p*. According to the second embodiment described above, it is possible as above to decrease the number of the level conversion circuits to one fourth of the first embodiment shown in FIG. 11 so as to reduce the number of the devices.

It is also possible to implement the AND gates of FIG. 11 with the NOR gates for inputting the negative logic or implement them by adding the inverters to the NAND gates for inputting a positive logic.

As the level conversion circuits 512 and 513 are placed in a preceding stage to the device driving signal circuit 504 and block selection circuit 505, the devices configuring the device driving signal circuit 504 and block selection circuit 505 are required to be of a high withstand voltage so that the device area becomes large. Therefore, a decision should be made as to whether the level conversion circuits 512 and 513 should be placed in the preceding stage or the subsequent stage to the circuits 504 and 505 considering a balance between a decrease in circuit area due to reduction in the number of devices necessary for the level conversion circuits and an increase in the circuit area in the case of rendering the withstand voltage of the circuits 504 and 505 higher.

For instance, if the number of input and output signal lines of the device driving signal circuit 504 remains unchanged, it is advantageous to place the level conversion circuit 512 in the subsequent stage to the device driving signal circuit 504. It is because the device driving signal circuit 504 can be configured with the devices of a low withstand voltage, which is advantageous in terms of implementation of higher density. Therefore, in such a case, the block selection circuit 505 should have the level conversion circuits provided in the preceding stage thereto, and the device driving signal circuit 504 should have the level conversion circuits provided in the subsequent stage thereto. As a matter of course, it is also possible to provide the level conversion circuits in the preceding stage to one of the circuits (the block selection circuit for instance) and provide them in the subsequent stage to the other circuit (the device driving signal circuit for instance).

As described above, it is possible, according to the second embodiment, to further reduce the circuit area related to the block selection circuit and device driving signal circuit in addition to the effects of the first embodiment.

Third Embodiment

Figure 12:
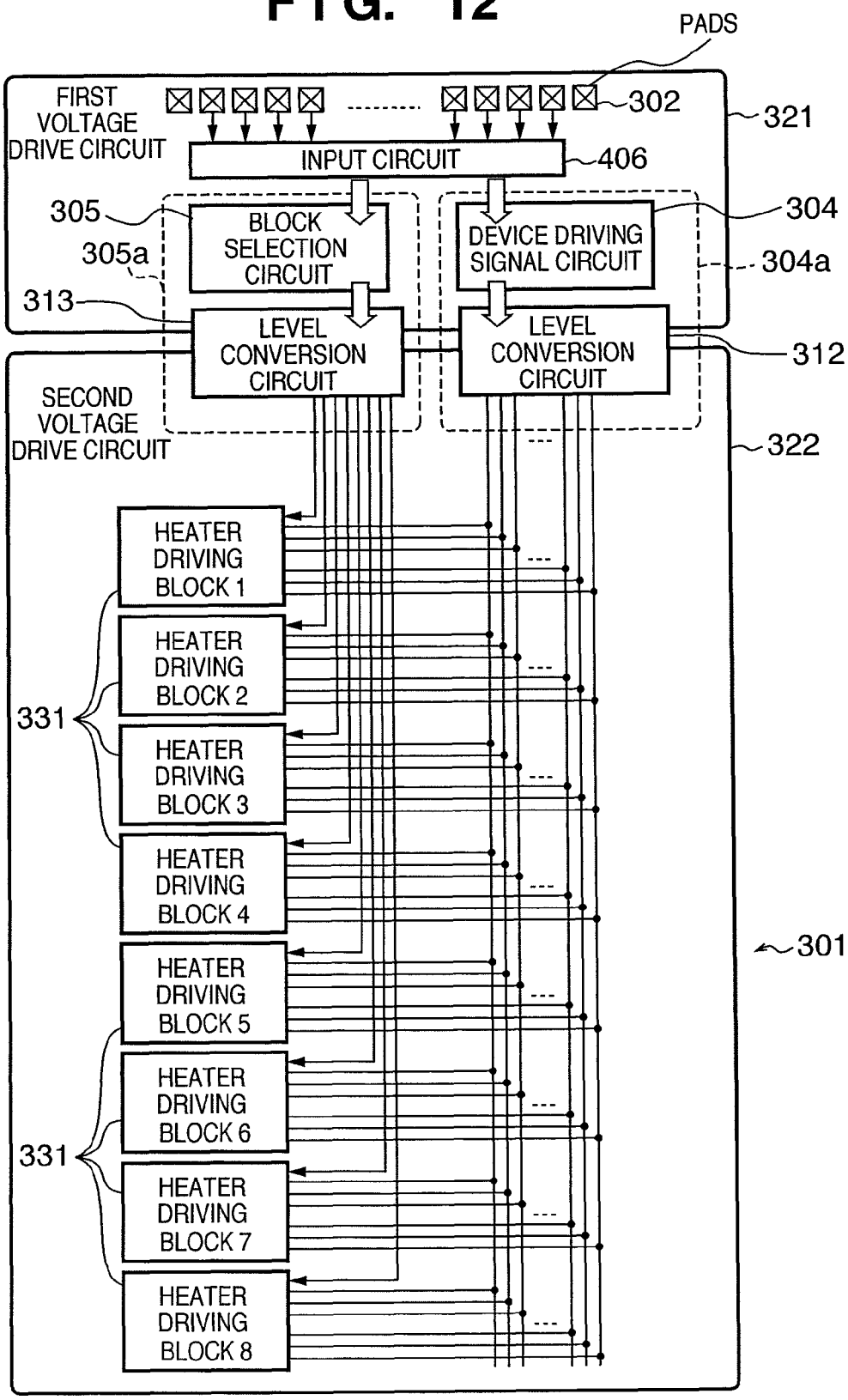
FIG. 12 is a diagram describing an overall circuit configuration example of the inkjet recording head substrate of a third embodiment.

FIG. 12 is a circuit block diagram for describing the inkjet recording head substrate (hereafter, a head substrate 301) and a diagram schematically showing flows of the electrical signals according to a third embodiment. The head substrate 301 is the one shown in the first embodiment (FIG. 7). FIG. 12 shows the functions of the circuit blocks and flows of the signals as to one circuit block group which is symmetrical centering on the ink supply ports 111 of FIG. 7. The head substrate 301 corresponds to the above-mentioned head substrate 301 in FIG. 19. The placement of the circuit blocks such as the ink supply ports, heater arrays and drive circuits is the same as the configuration shown in the first embodiment (FIG. 7), and so a description thereof will be omitted.

In FIG. 12, the signal including the image data to be applied to the pads 302 is connected to the block selection circuit 305 configuring an internal circuit via the input circuit 303. A part of the output signal of the block selection circuit 305 is supplied to the device driving signal circuit 304. The output signal of the device driving signal circuit 304 is supplied to multiple heater driving blocks 331 as the time division selection signal by way of the level conversion circuit 312.

The block selection circuit 304 has an image data signal synchronized with a synchronizing signal (clock) used to input the image data inputted thereto. The block selection circuit 304 generates a block selection signal for selecting the heater driving blocks 1 to 8 (331) based on the image data signal. The block selection signal generated by the block selection circuit 304 is supplied to the heater driving blocks 331 by way of the level conversion circuit 313. It is determined by the block selection signal whether or not each of the heater driving blocks 331 is effective. The heater driving block selected (determined to be effective) by the block selection signal drives the heater according to the time division selection signal from a device driving signal circuit 402. To be more specific, the heater to be driven is determined by an AND logic of the block selection signal and time division selection signal.

As described above, according to this embodiment, the block selection signal and time division selection signal outputted from the block selection circuit 305 and the device driving signal circuit 304 are level-converted by the level conversion circuits 313 and 312 (converted from the first power supply voltage to the second power supply voltage), and then, the signals are transmitted to the heater driving blocks 331. The circuit driven at the first power supply voltage which is the same potential as the input signal amplitude is the circuit block enclosed by a rectangle 321. The circuit driven at the second power supply voltage which is higher than the level-converted first power supply voltage is the circuit block enclosed by a rectangle 322. The level conversion circuits 313 and 312 have the same circuit configuration as the level conversion circuits described above in FIG. 6 (circuit portions 205*a* and 205*b*).

A circuit portion 305*a* (the block selection circuit 305 and level conversion circuit 313) and a circuit portion 304*a* (the device driving signal circuit 304 and level conversion circuit 312) both have the level conversion circuits provided in final stages. As described in the second embodiment, however, they may also have the configuration having the level conversion circuits provided in the preceding stage.

Figure 1:
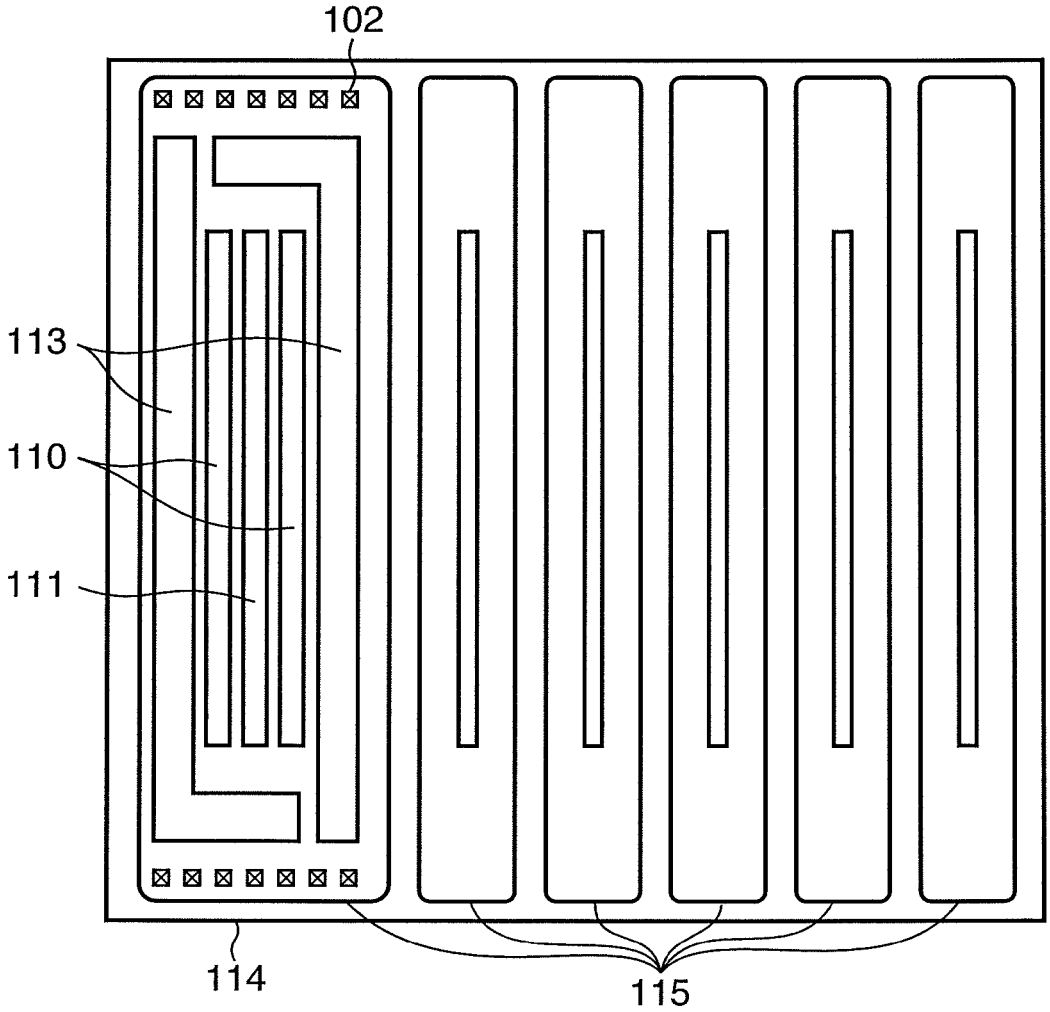
FIG. 1 is a diagram schematically showing circuit blocks and ink supply ports of an inkjet recording head substrate.
Figure 2:
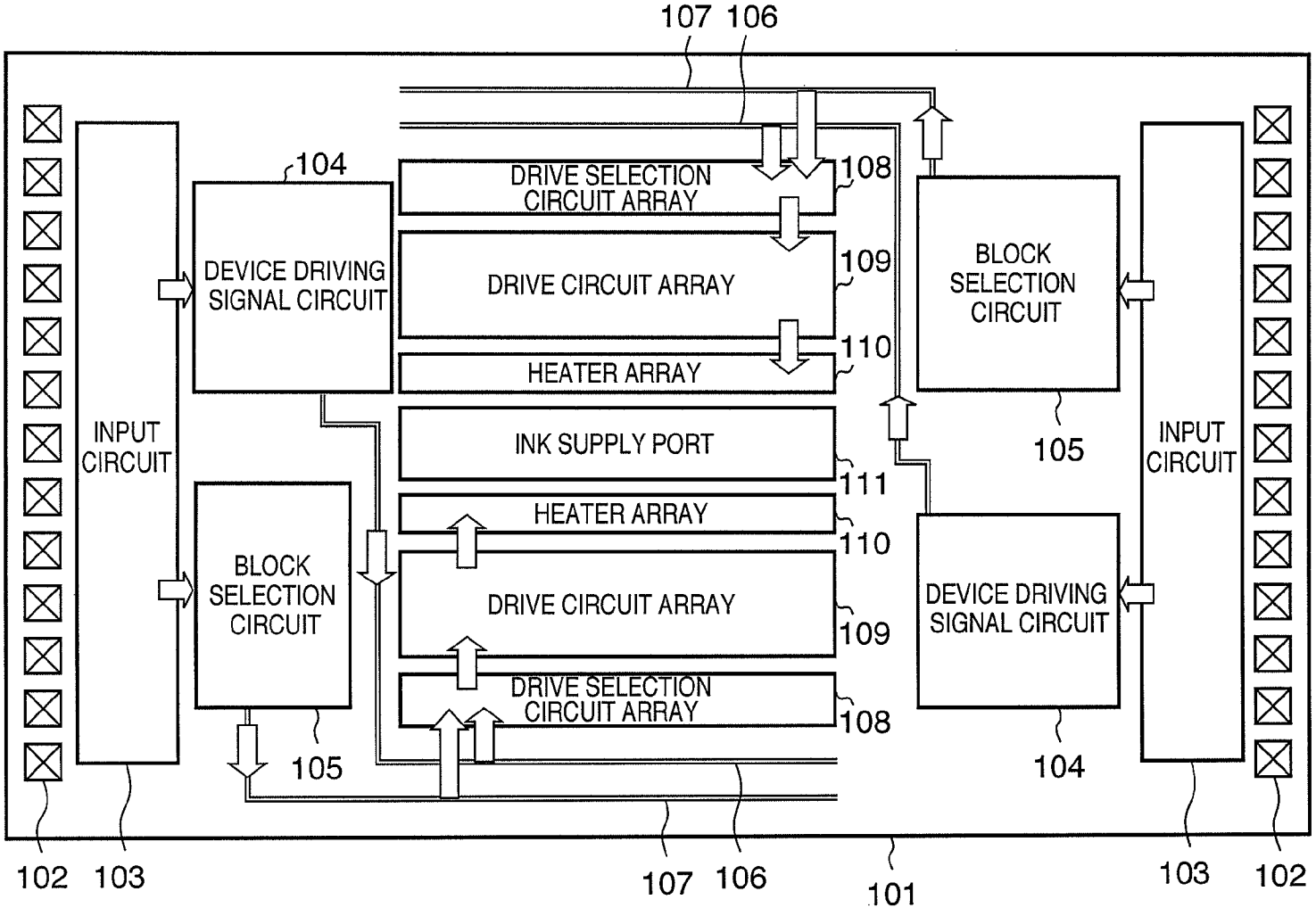
FIG. 2 is a schematic diagram showing circuit blocks and a flow of an electrical signal of one of the ink supply ports of the inkjet recording head substrate shown in FIG. 1.
Figure 3:
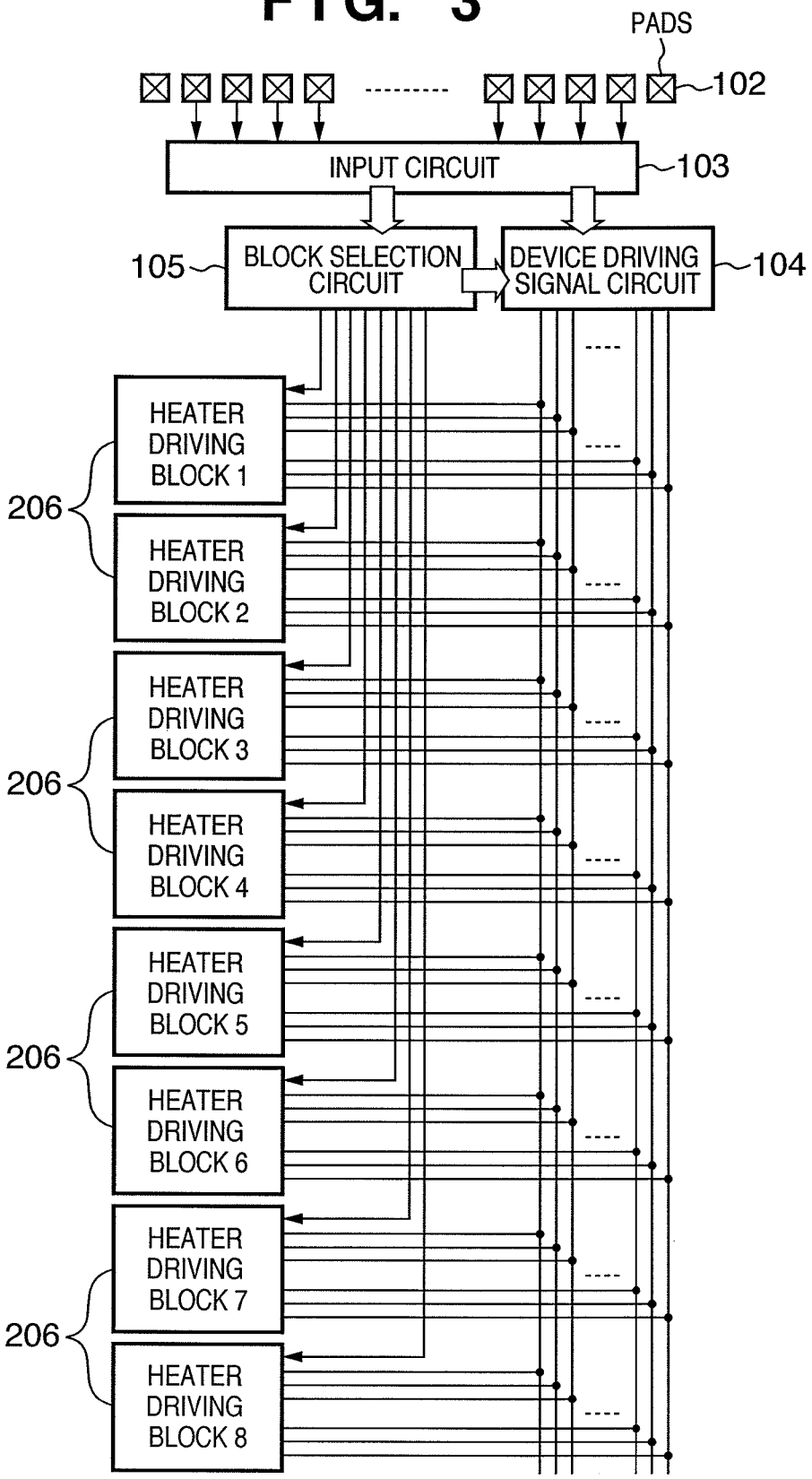
FIG. 3 is a diagram showing more detailed circuit configuration and flows of signals of drive circuits 113 of FIG. 1.
Figure 4:
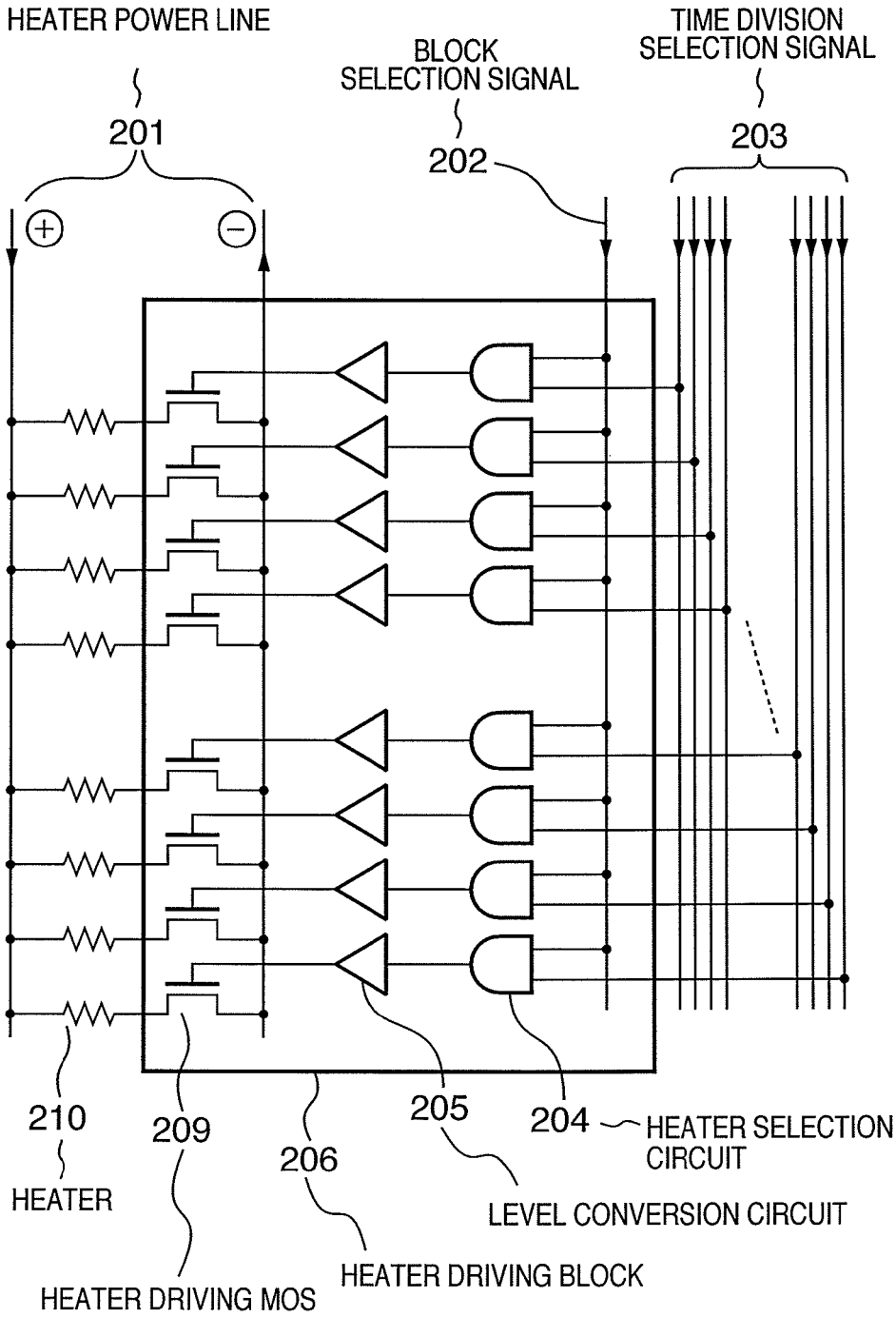
FIG. 4 is a diagram showing a circuit configuration example in a general heater driving block.

The head substrate 301 according to this embodiment performs the level conversion by providing the level conversion circuits 313 and 312 immediately after the output of the block selection circuit 305 or the device driving signal circuit 304. To be more specific, it becomes unnecessary to place the level conversion circuit for each heater by taking the configuration of this embodiment while the general circuit configuration shown in FIG. 3 requires the level conversion circuit 205 (FIG. 6) to be provided to each of the heater driving block 206 as shown in FIG. 4. Therefore, it is possible, as with the first and second embodiments, to obtain the effects of higher density of the circuits and reduction in the layout area.

Figure 13:
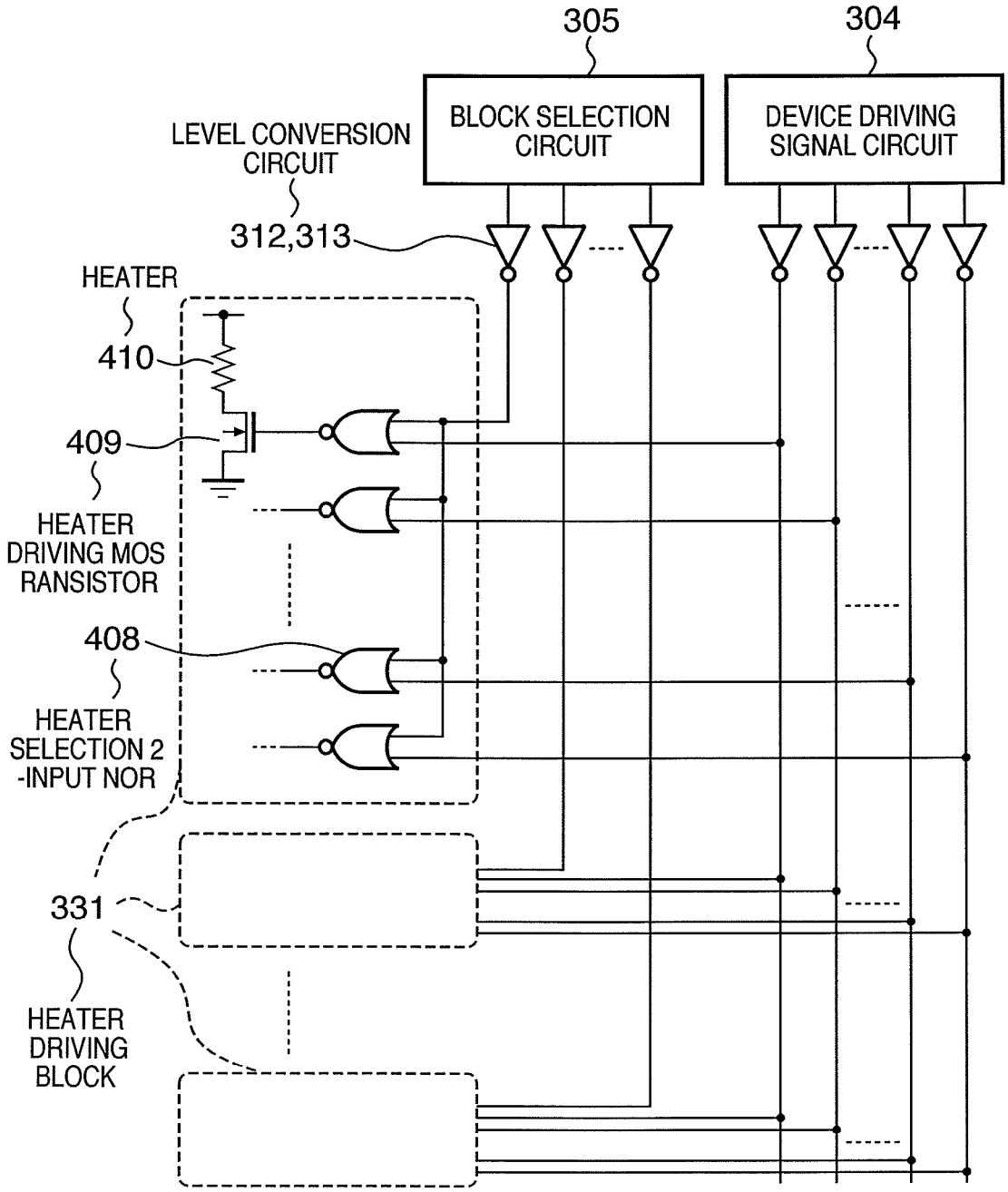
FIG. 13 is a diagram describing the configuration of the heater driving block according to the third embodiment.

The circuit block shown in FIG. 11 will be complementarily described by using FIG. 13. The output signals from the block selection circuit 305 and the device driving signal circuit 304 are level-converted by the level conversion circuits 312 and 313 from the first power supply voltage to the second power supply voltage and inputted to the heater driving blocks 331. As with the first embodiment, the heater driving block 331 has the heater driving MOS transistor 409 and the 2-input NOR 408 for selectively driving the heater driving MOS transistor 409 correspondingly to each heater 410 placed therein. In the example shown here, the output of the 2-input NOR 408 becomes logically high-level (hereafter, Hi) when both the input signals to the 2-input NOR 408 from the block selection circuit 305 and the device driving signal circuit 304 becomes logically low-level (hereafter, Lo). As the heater driving MOS transistor is NMOS, it becomes on-state when the output of the 2-input NOR 408 becomes Hi. Therefore, when the output of the 2-input NOR 408 is Hi, the heater driving MOS transistor 409 becomes on-state by having the second power supply voltage applied to its gate so that the current passes through the heater 410.

As for examples of the values of the power supply voltage in these instances, the first power supply voltage is 3 V to 5 V or so and the second power supply voltage is 10 V to 30 V or so. According to the third embodiment, the 2-input NOR 408 is used. Therefore, the inverters are added to the circuits shown in FIG. 6 in output stages of the level conversion circuits 312 and 313, and signal outputs (block selection signal and time division drive selection signal) are inverted (refer to FIG. 13).

A detailed circuit configuration example of the above-mentioned 2-input NOR 408 is as shown in FIG. 8. As described above, the 2-input NOR 408 has the block selection signal and time division selection signal after the level conversion as the inputs. The circuit elements 408*a* to 408*d* are the devices of a high withstand voltage for operating at the potential (VDDM) of the second power supply voltage respectively, and configure the drive selection circuit (NOR gate) corresponding to one heater. The output of the NOR gate 408 is connected to the gate of the NMOS transistor 409 which is the drive circuit for exerting on and off control of the heaters. The operation for turning on this segment is as described by referring to FIG. 8 in the first embodiment.

In the circuit of the head substrate according to the third embodiment, drive control is exerted by the two kinds of power supply voltage, that is, the first power supply voltage which is the voltage amplitude of the input signal and a higher second power supply voltage to be applied to the gate of the MOS transistor for controlling the heater current as with the first embodiment. The output signal of the drive circuit of the first power supply voltage is converted to the signal amplitude of the second power supply voltage by the level conversion circuit. In the configuration for performing the level conversion immediately after the block selection circuit 305 and the device driving signal circuit 304 (in the preceding stage to the heater driving block) as described above, the level conversion circuit should be placed to each of the block signal line and data signal line. For that reason, it is not necessary to place the level conversion circuit for each bit as in conventional configurations. Therefore, it is possible, compared with the circuit configurations shown in FIGS. 3 and 4, to obtain the effects of higher density of the circuits and reduction in the layout area.

It becomes necessary, on the other hand, to lead a logic signal of a high voltage amplitude after the level conversion to a heater array alignment direction of the substrate in order to transmit the signal having performed the level conversion to each bit. To be more specific, multiple signal lines for carrying the logic signals of a high voltage amplitude are routed along the heater array. As for recent printers, the number of nozzles is increased and print width is extended in order to achieve high-speed and high-quality recording. There is a tendency that the length of the heater array in the alignment direction is extended in conjunction with such an increase in the number of bits of the heater array. In conjunction with it, there is a tendency to extend a line length for leading the logic signals of a high voltage amplitude after the level conversion to the heater array alignment direction of the substrate in the configuration for performing the level conversion immediately after a shift register or the decoder.

In the case of routing the signal line of a high power supply voltage amplitude of 10 V to 30 V or so along the heater array as described above, there is a possibility that there may be an inversion of the channel of a field MOS transistor which is a parasitic MOS transistor wired to the gate, resulting in a malfunction of the circuit. Therefore, it is desirable to take a countermeasure against such a malfunction.

The case where such a malfunction occurs is the case where the parasitic MOS transistor becomes on-state in a boundary portion between an n-type substrate (n-well) region and a p-type substrate (p-well) region which are different potential layers of the substrate. In this case, the electrically separated n-well and p-well are put in a conducting state so as to cause the malfunction. Under ordinary circumstances, the wiring for turning on the parasitic MOS transistor is often the wiring layer in the closest layer to the substrate out of multiple wiring layers. The wiring layer formed in an upper layer farther from the substrate has a certain distance kept by an interlayer film so that it is difficult to turn on the parasitic MOS transistor.

For that reason, it is desirable, on a boundary between the n-well and p-well, to eliminate crossing in the wiring layer close to the substrate and perform the crossing after switching to a higher wiring layer. However, this wiring switching portion needs to secure the layout area for that purpose, leading to an increase in chip size. It is also necessary to form a contact for switching the wiring layer, and so a contact resistance is added resulting in a possibility of a delay in signal propagation.

Figures 14A, 14B:
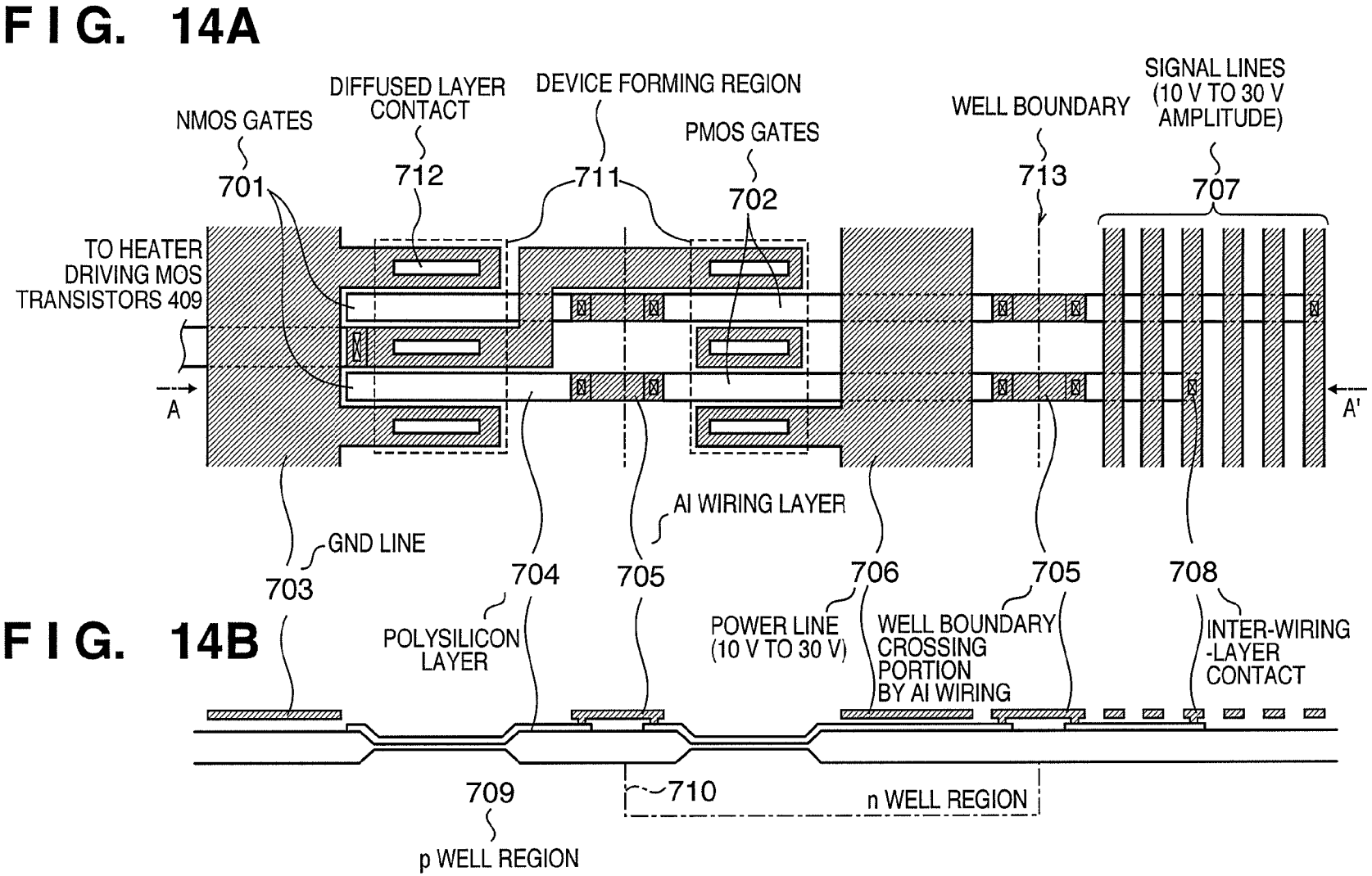
FIGS. 14A and 14B are diagrams showing a layout configuration example of the substrate shown in FIGS. 8 and 13.

FIGS. 14A and 14B are diagrams showing a layout example of the substrate for implementing the circuit shown in FIG. 8. FIGS. 14A and 14B show the configuration in which an n-well region 710 for forming PMOS devices is formed on a p-type substrate and the malfunction by the parasitic MOS transistor is prevented by switching to the wiring layer in the upper layer on the boundary between the n-well 710 and a p-well 709. FIG. 14A shows a top view of the layout and FIG. 14B shows a sectional view at A to A' in the layout top view.

This layout extracts and shows an arbitrary 2-input NOR 408 in the heater driving block shown in FIGS. 8 and 13 and the input signal lines to the 2-input NOR 408. Here, in the signal lines 707, the signals are transmitted, which are obtained by level-converting the output signals from the block selection circuit 305 and the device driving signal circuit 304 to the amplitude of the second power supply voltage by the level conversion circuits 313 and 312.

As described above, this embodiment is an example of having CMOS transistors formed on the p-type substrate. Therefore, the n-well region 710 is formed in order to form the PMOS transistors. Reference numeral 701 denotes the gates of the NMOS transistors (408*a* and 408*c* of FIG. 8) and reference numeral 702 denotes the gates of the PMOS transistors (408*b* and 408*d* of FIG. 8), which are formed by a polysilicon layer 704. The gates of the MOS transistors are formed in the area where the polysilicon layer 704 crosses a device forming region 711. In FIGS. 14A and 14B, the source and drain regions of the MOS transistors are not shown for the purpose of simplifying the diagram. The connection between a line A1 and the source and drain is made via a diffused layer contact 712.

To apply the input signal from the signal line 707 to the gate of the 2-input NOR 408, it is necessary to cross a power line 706 with the polysilicon layer. Here, there is a well boundary 713 of the n-well region and the p-well region between the power line 706 and the signal line 707. For this reason, if the well boundary 713 is crossed in the polysilicon layer, there is a possibility that it may turn on the parasitic MOS transistor of which gate is the polysilicon layer to pass an abnormal current and cause a malfunction. Therefore, as its configuration, the well boundary 713 is crossed by switching to an A1 wiring layer 705 further apart from the substrate than the polysilicon layer. In this switching portion, a contact forming region between the polysilicon layer and the A1 wiring layer is necessary and so predetermined layout area is occupied.

As for the third embodiment, a description will be given as to the head substrate for further reducing the chip size by decreasing the number of the switching portions installed.

Figures 15A, 15B:
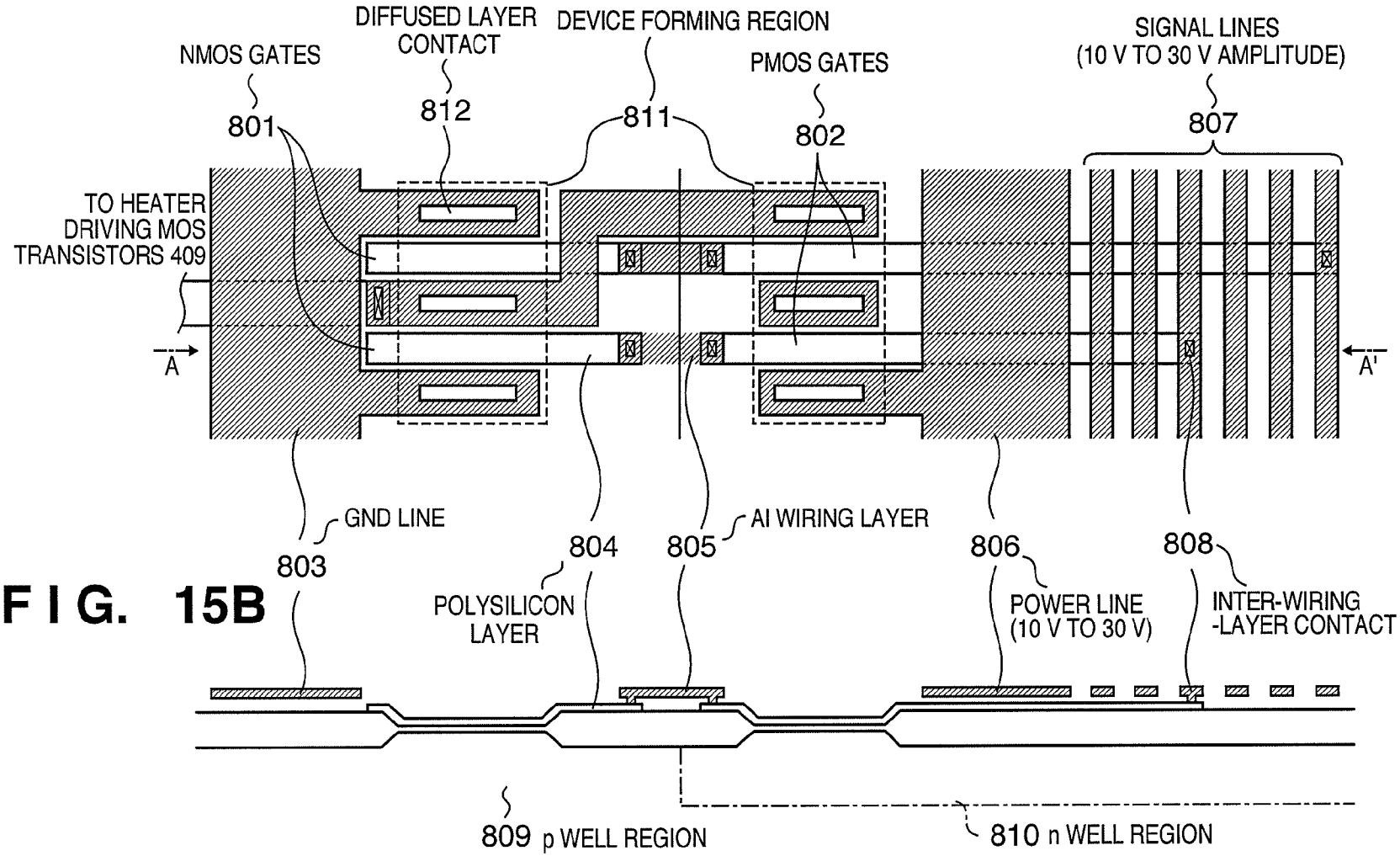
FIGS. 15A and 15B are diagrams showing a layout configuration example of the substrate according to the first embodiment.

FIGS. 15A and 15B are diagrams showing a layout example of the substrate of which malfunction prevention measure according to this embodiment has been described. FIG. 15A shows a top view of the layout and FIG. 15B shows a sectional view at A to A' in the layout top view. This embodiment shows an example in which the CMOS transistors are formed on the p-type substrate and the 2-input NOR 408 operating at a high power supply voltage of 10 V to 30 V or so is used to selectively drive the heater 410. To be more precise, the layout shown in FIGS. 15A and 15B indicates the layout of the portion for inputting the signals outputted to a signal line 807 extending in the heater alignment direction of the heater array to the 2-input NOR 408 placed correspondingly to the heaters. The signal line 807 has the signals applied thereto, which are the signals obtained by having the amplitude level of the logic signals outputted from the block selection circuit 305 and the device driving signal circuit 304 level-converted to the second power supply voltage higher than the amplitude level of the input signals by the level conversion circuits 313 and 312.

The 2-input NOR 408 of FIGS. 15A and 15B is the one extracted out of those placed like an array in the heater alignment direction correspondingly to the heaters. Reference numeral 801 denotes the gates of the NMOS transistors (408*a* and 408*c* of FIG. 8) and reference numeral 802 denotes the gates of the PMOS transistors (408*b* and 408*d* of FIG. 8), which are formed by a polysilicon layer 804. The gates of the MOS transistors are formed in the area where the polysilicon layer 804 crosses a device forming region 811. In FIGS. 15A and 15B, the source and drain regions of the MOS transistors are not shown for the purpose of simplifying the diagram. The connection between the line A1 and the source and drain is made via a diffused layer contact 812.

The signals applied to the gates of the NMOS transistors and PMOS transistors are applied from the signal lines 807. The signal lines 807 are multiple lines routed along the heater alignment direction. The 2-input NOR 408 placed like an array in the heater alignment direction is connected to arbitrary two signal lines out of multiple signal lines, and renders its output Hi when both the signals applied from the two signal lines become Lo. Furthermore, the output of the 2-input NOR 408 is connected to the heater driving MOS transistor 409 of the NMOS type. As for the power for driving the 2-input NOR 408, a GND line 803 is placed on the NMOS transistors side and a power line 806 is placed on the PMOS transistors side.

To apply the signal from the signal line 807 to the PMOS and NMOS transistors of a 2-input NOR 605, it needs to intersect with other signal line and power line. According to this embodiment, the signal line and power line are formed by an A1 wiring layer 805. Therefore, at an intersection, they are connected to the polysilicon wiring layer 804 which is another wiring layer via an inter-wiring-layer contact 808 so as to connect to the gates of the MOS transistors.

Of the MOS transistors configuring a CMOS transistor circuit (the 2-input NOR 408 of this embodiment) for selectively driving the heaters, the transistors (NMOS transistors 408*a* and 408*c* in this example) forming the channel of the same type as the heater driving MOS transistor 409 are placed by sandwiching the GND line 803 between themselves and driver transistors on the driver transistors side. On the other hand, the signal lines 807 for inputting to the 2-input NOR and the transistors (PMOS transistors 408*b* and 408*d*) forming the channel of a different type from the driver MOS transistors are placed by sandwiching the power line 806.

A p-well region 809 of the same potential as a GND potential (substrate potential) is formed in a substrate layer immediately under the heater driving MOS transistor 409 (not shown in FIGS. 15A and 15B), GND line 803 and NMOS transistor 801. An n-well region 810 of the same potential as the power supply potential (second power supply voltage) is formed in the substrate layer immediately under the PMOS transistors 802, power line 805 and signal lines 807. To be more specific, the n-well region is formed to extend to under the signal lines 807 compared to the layout of FIGS. 14A and 14B.

This n-well region is formed to include a lower layer 807 of the signal lines, and is extended to the output portion of the conversion circuit 313. As for the conversion circuit 313, it is also desirable, as in FIGS. 15, to place the PMOS transistors at the position close to the signal lines 807 and extend the n-well region to the PMOS transistors in the conversion circuits 313.

If the layout shown in FIGS. 15A and 15B is employed, all silicon substrate potentials immediately under a signal application route where a signal is transferred to the PMOS transistors 408*b* and 408*d* of the 2-input NOR 408 from the signal lines 807, become the n-well layer 810 of the power supply potential. For this reason, the boundary between the n-well layer 810 and the p-well layer 809 is not crossed any more. Therefore, switching to the A1 wiring layer 805 becomes unnecessary, and so the layout area can be reduced. In an output portion of the 2-input NOR 408, signal lines switch to the polysilicon layer in a side of the NMOS transistors 408*a* and 408*c* and apply the signals directly to NMOS driver gates. By virtue of the above, signals are entirely routed by polysilicon wiring on the p-well layer 809 and the switching to the A1 wiring is no longer necessary.

Thus, the layout shown in FIGS. 15A and 15B has the n-well layer of the power supply potential placed immediately under the signal lines 807 where no n-well layer is conventionally placed. The signal lines 807 and the PMOS configuring the CMOS transistors as a selection circuit are placed by sandwiching the power line 806 so that the well boundary of which signal line to be routed in the polysilicon layer is different is no longer crossed. To be more specific, the switching portion to the A1 wiring as a countermeasure against the parasitic MOS transistor in the area becomes unnecessary, and so it is possible to realize the inkjet recording head substrate having its layout area reduced and causing no malfunction.

Fourth Embodiment

Figures 16A, 16B:
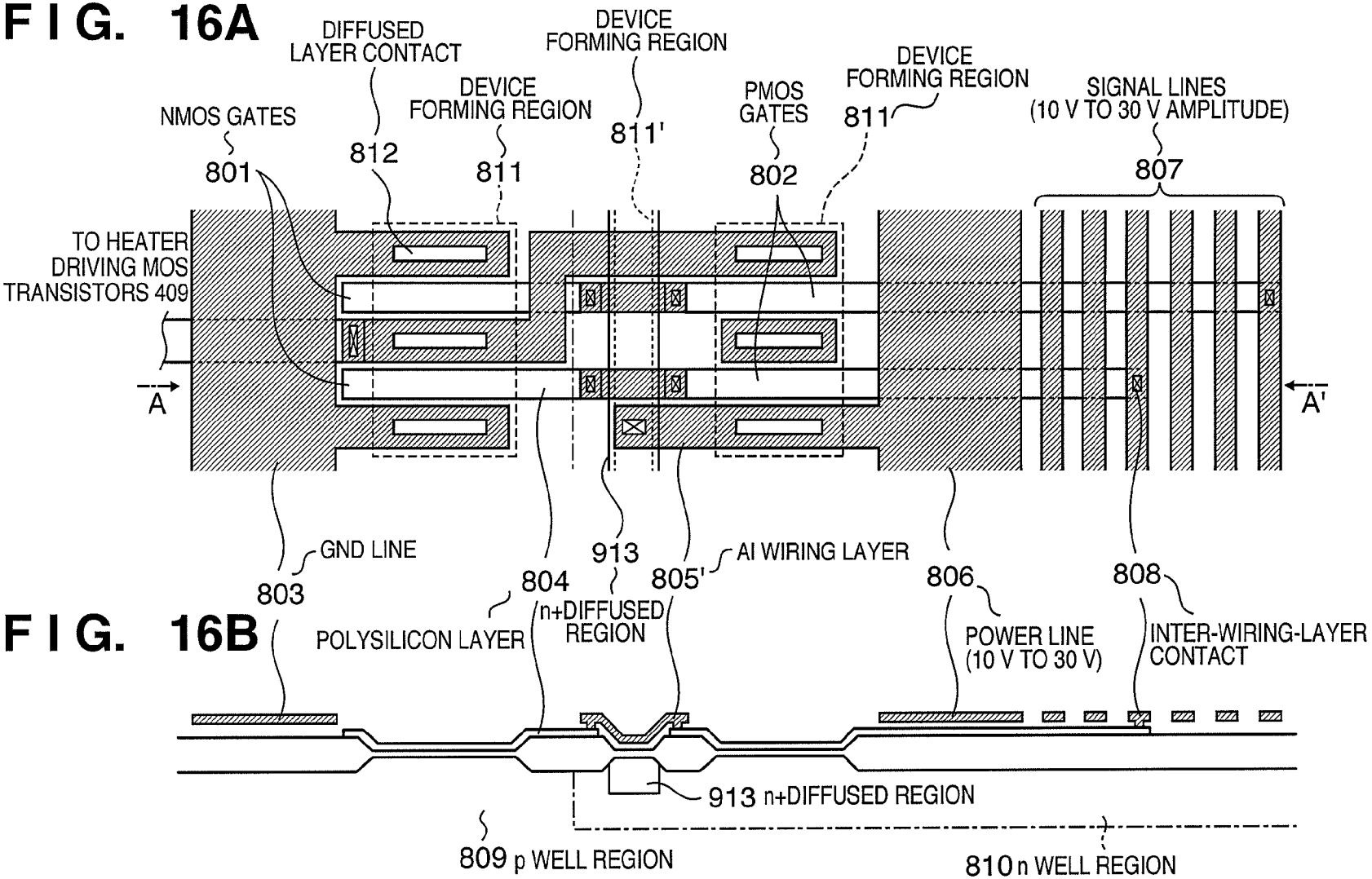
FIGS. 16A and 16B are diagrams showing a layout configuration example of the substrate according to the second embodiment.

FIGS. 16A and 16B are diagrams showing a top view of the layout for describing the second embodiment and a sectional view at A to A' in the layout view correspondingly to each other.

According to the third embodiment, the switching to the A1 wiring is performed as the countermeasure against the parasitic MOS transistor for the well boundary existing between the PMOS and the NMOS, as in the conventional cases. According to the fourth embodiment in comparison, the countermeasure against the parasitic MOS transistor is realized by inserting a well contact. As for the well contact, a device forming region 811' is newly formed between the PMOS and the NMOS, and an n+diffused region 913 of an impurity concentration higher than the well regions is formed in the device forming region 811'. The n+diffused region 913 contacts the A1 wiring layer extended by way of the source of the PMOS transistors 802 connected to the power line 806, and is connected to a power line potential (10 V to 30 V).

There is no problem in particular as to the field MOS countermeasure between the PMOS and the NMOS due to formation of the n+diffused region 913 (well contact, guard ring) as in this embodiment. It is because, while an inversion layer is formed around the surface of the well layer of a low impurity concentration and a malfunction occurs with the inversion layer as the channel in the case of the field MOS, it becomes difficult to form the inversion layer in this region by placing a region of a high impurity concentration as the well contact. Therefore, it is no longer a problem, if the form of the fourth embodiment is employed, to have the polysilicon layer placed astride the well boundary. Furthermore, it is also possible to simultaneously secure a withstanding capacity against a latch-up caused by power supply noise and so on by placing the well contact between the NMOS transistor and the PMOS transistor.

Here, influence of the parasitic MOS transistor is prevented by placing the diffused layer of the power supply potential in the n-well region. As for this impurity region, it is possible to obtain the same effects either by placing the diffused layer of the substrate potential in the p-well region or placing both the diffused layers.

The logical configurations indicated in the embodiments are just examples. It is also possible, for instance, to have a logical configuration having the NAND gate, inverter, complex gate or a combination of these gates instead of the 2-input NOR 408. One of the important points of the circuit configurations of the third and fourth embodiments is to match the well region type (p-type or n-type) of the substrate layer immediately under the plurality of signal lines (807) with the well region type for configuring a device group adjacent to the plurality of signal lines. It is thereby possible to eliminate the well boundary 713 of FIGS. 14A and 14B and exclude the wiring switching portion in this part.

As described above, it is possible, according to the embodiments, to reduce the number of the devices of a high withstand voltage placed in each segment and achieve higher density of the selection circuit.

According to the embodiments, it is possible to reduce the scale of the level conversion circuit, curb an increase in the substrate size and simplify the circuit configuration. It is also possible to improve the yield by reducing the number of the devices formed on the substrate. Furthermore, it is possible to eliminate a malfunction and realize a stable operation in such reduction of the substrate size.

As many apparently widely different embodiments of the present invention can be made without departing from the spirit and scope thereof, it is to be understood that the invention is not limited to the specific embodiments thereof except as defined in the claims.

CLAIM OF PRIORITY

This application claims priority from Japanese Patent Application No. 2004-357182 filed on Dec. 9, 2004 and Patent Application No. 2004-357184 filed on Dec. 9, 2004, which are hereby incorporated by reference herein.

What is claimed is:

1. An inkjet recording head substrate comprising:

a plurality of electrothermal transducers for generating thermal energy used to discharge ink, the plurality of electrothermal transducers being arranged in a predetermined direction;

a plurality of drive elements for respectively driving the electrothermal transducers;

a first circuit which, based on input signals having a first voltage amplitude level, outputs selection signals having a second voltage amplitude level which is higher than the first voltage amplitude level for selecting electrothermal transducers to be driven; and a second circuit which comprises a plurality of NOR gate circuits, each of which is provided corresponding to each of the plurality of drive elements, wherein each NOR gate circuit performs NOR operation on a selection signal input from the first circuit and outputs a signal relating to a result of the operation to a drive element corresponding to said NOR gate circuit; and wherein each of the NOR gate circuits has a first element group composed of a plurality of first type semiconductor elements arranged in the predetermined direction and a second element group composed of a plurality of second type semiconductor elements arranged in the predetermined direction, the first and second element groups being arranged in a direction crossing the predetermined direction.

2. The substrate according to claim 1, wherein the first type semiconductor elements of each NOR gate circuit are composed of N type MOS transistors, and the second type semiconductor elements of each NOR gate circuit are composed of P type MOS transistors.

3. The substrate according to claim 1, wherein the drive element is composed of N type MOS transistors.

4. The substrate according to claim 1, wherein the inkjet recording head substrate comprises signal lines that are arranged to extend in the predetermined direction so as to transfer the selection signals output from the first circuit, and wherein the first element group and the second element group are arranged between the drive elements and the signal lines on the substrate.

5. The substrate according to claim 4, wherein the first element group is arranged on a side of the drive element and the second element group is arranged on a side of the signal lines.

6. An inkjet recording head comprising the substrate according to claim 1.

7. The substrate according to claim 2, wherein a p-well region is formed in a substrate layer under at least one N type MOS transistor, and an n-well region is formed in a substrate layer under at least one P type MOS transistor.

8. The substrate according to claim 7, further comprising a plurality of signal lines that are arranged to extend in the predetermined direction so as to transfer the selection signals output from the first circuit, wherein the n-well region is formed in a substrate layer under the signal lines.

9. An inkjet recording head substrate having a plurality of electrothermal transducers placed in a predetermined direction, which generates thermal energy used to discharge ink, and a plurality of drive elements configured by a semiconductor device, each of which is connected to and drives each of the plurality of electrothermal transducers mounted thereon, said substrate comprising:

a first circuit portion for outputting selection signals, for selecting an electrothermal transducer to be driven, at an amplitude level of a second voltage higher than a first voltage based on an input signal of the amplitude level of the first voltage;

a second circuit portion including a first device group consisting of semiconductor devices of the same type as the plurality of drive elements and a second device group consisting of semiconductor devices of a different type from the plurality of drive elements, which receives the selection signals from the first circuit portion and controls the drive element corresponding to the electrothermal transducer selected by the selection signals; and a plurality of signal lines extending in the predetermined direction, for transmitting the selection signals from the first circuit portion to the second circuit portion, wherein the first device group and the second device group are placed between the drive elements and the plurality of signal lines, the first device group and the second device group are placed alongside in a direction intersecting with the predetermined direction, the first device group is placed on the drive element side, and the second device group is placed on the plurality of signal lines side.

10. The substrate according to claim 9, wherein the drive element and the first device group are configured by N-type MOS transistors, and the second device group is configured by P-type MOS transistors.

11. The substrate according to claim 9, wherein a power line for supplying the second voltage is placed between the second device group and the plurality of signal lines.

12. The substrate according to claim 9, wherein a well contact conducting to a substrate potential is provided between the first device group and the second device group.

13. The substrate according to claim 9, wherein a well contact conducting to a power supply potential of the second voltage is provided between the first device group and the second device group.

14. The substrate according to claim 10, wherein a substrate layer forming the second device group is an N-type layer, and the substrate layer extends to under the plurality of signal lines.

15. An inkjet recording head having the inkjet recording head substrate according to claim 9.

16. An inkjet recording head cartridge comprising:

the inkjet recording head according to claim 15; and an ink tank filled with the ink to be supplied to the inkjet recording head.

17. An inkjet recording apparatus comprising the inkjet recording head according to claim 15.

18. An inkjet recording apparatus comprising the inkjet recording head cartridge according to claim 16.

* * * * *